US008702132B2

(12) United States Patent
Tien

(10) Patent No.: US 8,702,132 B2
(45) Date of Patent: Apr. 22, 2014

(54) LATCH ASSEMBLY FOR A PASSAGEWAY DOOR LOCK

(75) Inventor: Hung-Jen Tien, Taiwan (TW)

(73) Assignee: I-Tek Metal Mfg., Co., Ltd., Tainan (TW)

( * ) Notice: Subject to any disclaimer, the term of this patent is extended or adjusted under 35 U.S.C. 154(b) by 249 days.

(21) Appl. No.: 13/298,417

(22) Filed: Nov. 17, 2011

(65) Prior Publication Data

US 2013/0127184 A1 May 23, 2013

(51) Int. Cl.
*E05C 3/12* (2006.01)
*E05B 65/10* (2006.01)

(52) U.S. Cl.
USPC ..... 292/219; 292/92; 292/93; 292/94; 292/DIG. 66

(58) Field of Classification Search
USPC ..... 292/219, 194, 1, 92, 93, 94, DIG. 61, 292/DIG. 65, DIG. 66
See application file for complete search history.

(56) References Cited

U.S. PATENT DOCUMENTS

| | | | | |
|---|---|---|---|---|
| 7,748,757 | B2 * | 7/2010 | Shen | 292/92 |
| 7,887,107 | B2 * | 2/2011 | Shen | 292/92 |
| 8,146,962 | B2 * | 4/2012 | Lu et al. | 292/93 |
| 8,523,248 | B2 * | 9/2013 | Tien | 292/194 |
| 2009/0194999 | A1 * | 8/2009 | Shen | 292/219 |
| 2013/0093195 | A1 * | 4/2013 | Tien | 292/93 |

* cited by examiner

*Primary Examiner* — Kristina Fulton
*Assistant Examiner* — Faria Ahmad
(74) *Attorney, Agent, or Firm* — Alan Kamrath; Kamrath IP Lawfirm, P.A.

(57) ABSTRACT

A latch assembly includes a base having two sidewalls each having first and second guiding slots. A latch is pivotably connected to the base. A follower plate is movably received in the base and includes two sidewalls each having a restraining slot and an engaging notch. A safety plate is mounted between the sidewalls of the follower plate. A pin extends through the first guiding slots of the base, the restraining slots of the follower plate, and the safety plate. A positioning pin extends through the second guiding slots. A spring is attached between the positioning pin and the pin. When latch moves from a latching position to an unlatching position, the positioning pin moves along the second guiding slots of the base under action of the spring and engages with the engaging notches of the follower plate to retain the latch in the unlatching position.

5 Claims, 16 Drawing Sheets

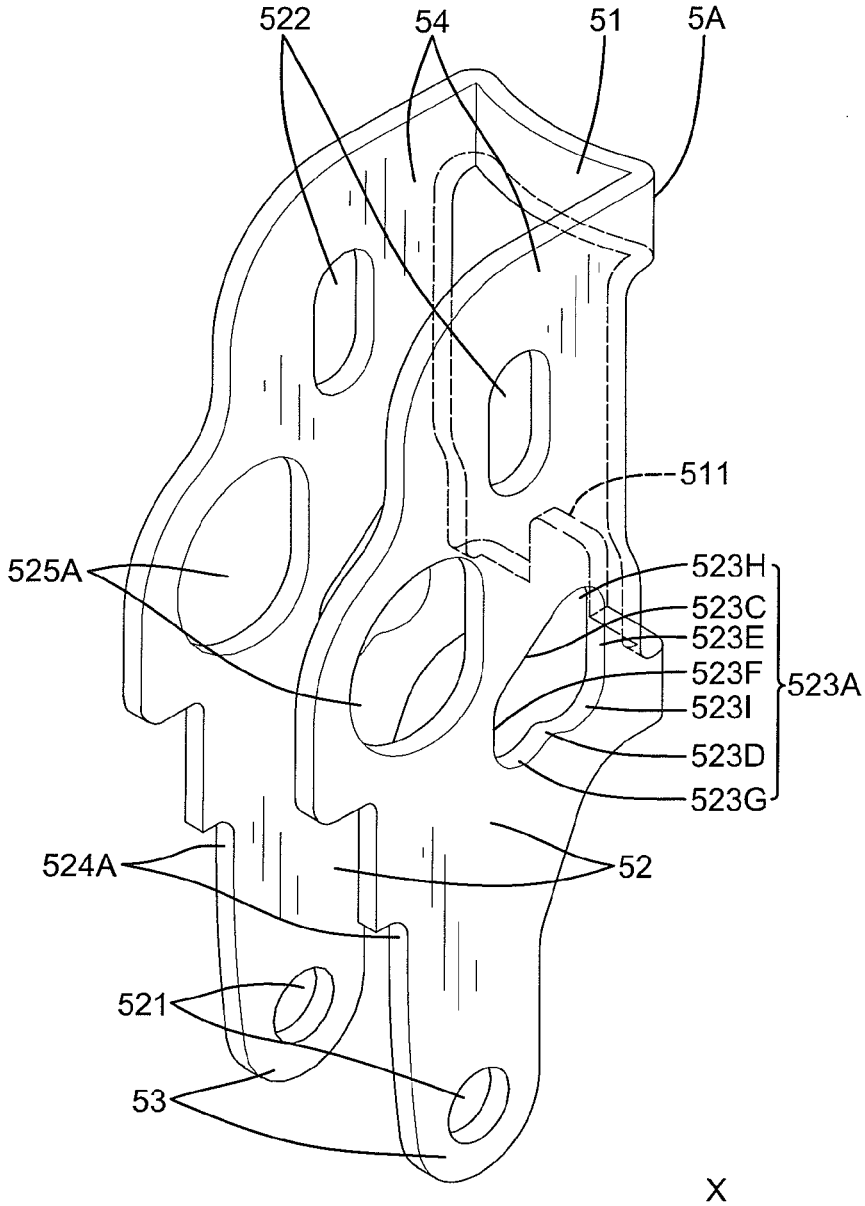
FIG.2A
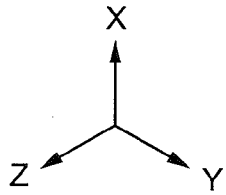

4
86
85
8
81
44
87
84
41
85
411
87
421
412
425
82
42
423
422
43
83
424
37
55
329
31
72
73
321
3
33
741
329
74
32
321
56
7
742
324
324
32
328
323
325
327
322
325
322
71B
711
713
521
53
716
53
51
34
712
712
715
524B
524B
719
523B
523B
718
57
527
525B
52
529
61
717
714
801B
611
522
805
819
54
52
522
803
857B
6
54
5B
817
X
24

62
Z
Y

LATCH ASSEMBLY FOR A PASSAGEWAY DOOR LOCK

BACKGROUND OF THE INVENTION

The present invention relates to a latch assembly for a passageway door lock and, more particularly, to a latch assembly for a door lock mounted in a passageway or panic exit, with the latch assembly including a latch that can be reliably retained in an unlatching position.

Locks mounted to doors in passageways or panic exits generally include horizontal type latches and vertical type latches. Vertical type latches include a top latch and a bottom latch. The latch bolts of the top and bottom latches should be retained by corresponding strikes in extended, latching positions when the door is closed and should be in retracted, unlatching positions when the door is being opened. The top and bottom latches generally move jointly such that one can not move without moving the other. However, in a case that the latch bolt of the top latch is moved to the unlatching position, due to the backlashes of the parts of the bottom latch after assembly, the latch bolt of the bottom latch could be further moved towards the latching position to a location interfering with the ground. As a result, the door can not be smoothly opened even though the latch bolt of the bottom latch is not in the latching position.

Thus, a need exists for a latch assembly for a passageway door lock in which the latch assembly can be reliably retained in the unlatching position to avoid interference to opening of the door.

BRIEF SUMMARY OF THE INVENTION

The present invention solves this need and other problems in the field of smooth opening of passageway doors by providing a latch assembly including a base having first and second sidewalls and a main section extending between the first and second sidewalls. Each of the first and second sidewalls of the base includes a first sliding groove, a first guiding groove, and a second guiding groove. The first guiding groove of each of the first and second sidewalls of the base includes a vertical section and an inclined section. The main section is adapted to be mounted to a door. A latch is movably received between the first and second sidewalls of the base. The latch has a first pivotal portion pivotably connected to the first and second sidewalls of the base and a second pivotal portion. The latch is movable between a latching position outside the base and an unlatching position inside the base. A link includes a first end pivotably connected to the second pivotal portion of the latch. A second end of the link is slideably engaged with the first and second sidewalls of the base. Movement of the link along a first axis causes movement of the latch between the latching position and the unlatching position.

The latch assembly further includes a follower plate movable along the first axis. The follower plate includes first and second sidewalls spaced along a second axis perpendicular to the first axis and an intermediate portion extending between the first and second sidewalls of the follower plate. Each of the first and second sidewalls of the follower plate includes first and second ends. The first and second sidewalls of the follower plate are movably received between the first and second sidewalls of the base. A restraining slot is formed in each of the first and second sidewalls of the follower plate and located between the first and second ends of the first and second sidewalls of the follower plate. The restraining slot of each of the first and second sidewalls of the follower plate includes upper and lower edges spaced along the first axis and parallel, spaced, first and second lateral edges extending between the upper and lower edges. The upper edge has an upper end connected to an upper end of the first lateral edge. The upper edge has a lower end connected to an upper end of the second lateral edge. The first and second lateral edges are substantially parallel to the vertical sections of the first guiding slots of the base. A first corner is formed between a lower end of the second lateral edge and an end of the lower edge. A second corner is formed between the upper end of the upper edge and the upper end of the first lateral edge. A third corner is formed between a lower end of the first lateral edge and the other end of the lower edge. Each of the first and second sidewalls of the follower plate further includes an engaging notch and a slot. The restraining slot is located between the engaging notch and the intermediate portion of the follower plate along a third axis perpendicular to the first and second axes. The slot extends in a direction parallel to the first and second lateral edges. The first ends of the first and second sidewalls of the follower plate are pivotably connected to the second end of the link. The first corners of the restraining slots of the follower plate are aligned with the inclined sections of the first guiding slots of the base when the latch is in the latching position. When the latch is in the unlatching position, the second corners of the restraining slots of the follower plate are aligned with distal ends of the vertical sections of the first guiding slots of the base, and the engaging notches of the follower plate are aligned with the second guiding slots of the base.

The latch assembly further includes a linking rod having a first end slideably coupled with the slots of the first and second sidewalls of the follower plate. The linking rod further includes a second end adapted to be connected to a door lock mounted to the door to move therewith. A safety plate is mounted between the first and second sidewalls of the follower plate. The safety plate includes two sidewalls spaced along the second axis. Each of the two sidewalls of the safety plate includes first and second ends. The second end of the two sidewalls of the safety plate pivotably connected to the first end of the linking rod. Each of the two sidewalls of the safety plate further includes an engaging notch and a hole. A pin extends through the first guiding slots of the base, the restraining slots of the follower plate, and the holes of the safety plate. The safety plate is pivotable relative to the follower plate about a pivot axis defined by the pin. A positioning pin extends through the second guiding slots of the base. A spring is attached between the positioning pin and the pin to bias the positioning pin and the pin towards each other.

When the latch is in the latching position, the engaging notches of the safety plate are engaged with the positioning pin. The pin is located in distal ends of the inclined sections of the first guiding slots of the base and in the first corners of the restraining slots of the follower plate. The positioning plate is stopped by the positioning pin when the latch is picked, preventing the latch from moving from the latching position to the unlatching position by avoiding the follower plate from moving along the first axis.

When the linking rod moves along the first axis away from the latch through a travel substantially equal to a length of each of the slots of the follower plate while the latch is in the latching position, the engaging notches of the safety plate disengage from the positioning pin. The pin moves to an intersection of the vertical section and the inclined slot of each of the first guiding slots of the base and abuts the first lateral edge of each of the restraining slots of the follower plate.

When the latch is in the latching position and when the linking rod moves along the first axis away from the latch through a travel larger than the length of each of the slots of the follower plate, the latch moves from the latching position to the unlatching position. The positioning pin moves along the second guiding slots of the base under action of the spring and engages with the engaging notches of the follower plate to retain the latch in the unlatching position. The pin is located in the distal ends of the vertical sections of the first guiding slots of the base and in the second corners of the restraining slots of the follower plate.

When the latch is in the unlatching position and when the linking rod moves along the first axis towards the latch through a travel slightly smaller than the length of each of the slots of the follower plate, the first ends of the two sidewalls of the safety plate press against the positioning pin to move the positioning pin along the second guiding slots of the base, disengaging the positioning pin from the engaging notches of the follower plate and releasing the follower plate, and the latch moves from the unlatching position to the latching position under action of another spring.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where:

FIG. 2A shows a perspective view of a follower plate of the bottom latch of FIG. 2.

Figure 1:
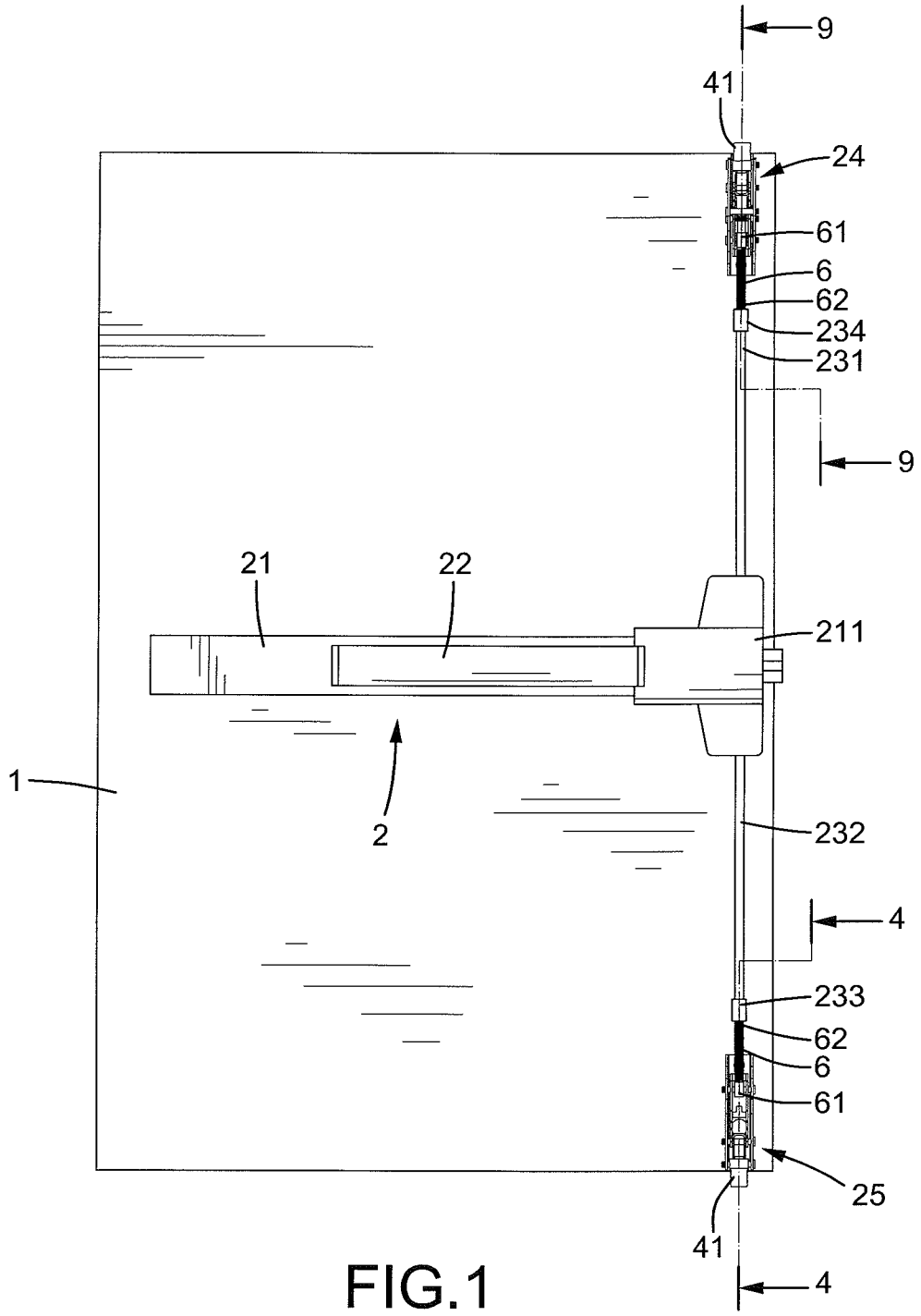
FIG. 1 shows a diagrammatic side view of a door lock mounted to a passageway door and utilizing latch assemblies according to the present invention.

All figures are drawn for ease of explanation of the basic teachings of the present invention only; the extensions of the Figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "lower", "upper", "top", "bottom", "inner", "outer", "end", "portion", "section", "longitudinal", "vertical", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

FIG. 1 shows a fireproof door lock 2 mounted to a door 1 in a passageway, a panic exit, or the like. In the form shown, door lock 2 includes a housing 21 is mounted to door 1, a touch bar 22 mounted outside housing 21 for manual operation, and a transmission mechanism (not shown) mounted in an end 211 of housing 21. Door lock 2 further includes a top latch 24 and an upper vertical rod 231 having a lower end coupled with the transmission mechanism and an upper end 234 coupled with top latch 24. Door lock 2 further includes a bottom latch 25 and a lower vertical rod 232 having an upper end coupled with the transmission mechanism and a lower end 233 coupled with bottom latch 25. When touch bar 22 is pressed, upper and lower vertical rods 231 and 232 are moved toward each other in a vertical direction to unlatch top and bottom latches 24 and 25. The transmission mechanism can be of any desired form as conventional including but not limited to of a commercially available type.

In the form shown, bottom latch 25 is comprised of the basic parts of top latch 24. According to the form shown, bottom latch 25 includes a base 3, a latch bolt 4, a follower plate 5A, a linking rod 6, and a locking device 7. Base 3 is substantially U-shaped and includes first and second sidewalls 32 and a main section 31 extending between first and second sidewalls 32. Main section 31 includes first and second ends 37 and 38 spaced along a first axis X. Main section 31 includes first and second holes 311 and 312 spaced along first axis X. A protrusion 314 is formed between first and second holes 311 and 312. First and second sidewalls 32 are spaced along a second axis Y perpendicular to first axis X, and each includes first and second ends 33 and 34 spaced along first axis X. First and second sidewalls 32 include aligned first sliding slots 321 adjacent first ends 33 and aligned second sliding slots 322 adjacent second ends 34. Each of first and second sliding slots 321 and 322 has a length extending along first axis X. First and second sidewalls 32 further include aligned first guiding slots 323 and aligned second guiding slots 324. First guiding slot 323 on each of first and second sidewalls 32 is located between first sliding slot 321 and second sliding slot 322 along first axis X. Furthermore, first guiding slot 323 includes a vertical section 327 extending in a direction parallel to first sliding slot 321 and an inclined section 328 at an obtuse angle (about 130° in the form shown) to vertical section 327. Second guiding slot 324 on each of first and second sidewalls 32 is located between first guiding slot 323 and first sliding slot 321 along first axis X. Second guiding slot 324 has a length extending along a third axis X perpendicular to first and second axes X and Y (i.e., perpendicular to first sliding slot 321). First and second sidewalls 32 further include aligned pin holes 329 at first ends 33 thereof. First and second sidewalls 32 further include aligned positioning holes 325. Positioning hole 325 on each of first and second sidewalls 32 is spaced from first guiding slot 323 along third axis Z. In assembly, a screw 35 (the lower one in FIG. 4) is extended through first hole 311 of base 3 into a side 11 of door 1, and another screw 35 (the upper one in FIG. 4) is extended through second hole 312 into side 11 of door 1. Base 3 is, thus, fixedly mounted to door 1.

According to the form shown, latch bolt 4 is mounted between first and second sidewalls 32 of base 3 and includes a latch 41 and a link 42. Latch 41 includes a first pivotal portion 411 on an end thereof and a second pivotal portion 412 between two ends of the latch 41. A pin 43 is extended through pin holes 329 of first and second sidewalls 32 of base 3 and first pivotal portion 411. Thus, the other end of latch 41 is pivotable between a latching position (FIG. 4) outside base 3 and an unlatching position (FIG. 6) inside base 3 about a pivot axis parallel to second axis Y. Link 42 includes a first end 421 pivotally connected to second pivotal portion 412 and a second end 422. Link 42 is substantially U-shaped and includes two sidewalls 426 spaced along second axis Y and an intermediate portion 424 extending between sidewalls 426. Sidewalls 426 include aligned holes 425 in first ends thereof and aligned holes 423 in second ends thereof. A pin 44 is extended through holes 425 of link 42 and second pivotal portion 412 of latch 41, allowing link 42 to pivot about a pivot axis defined by pin 44 that is parallel to the pivot axis of pin 43. A pin 55 is extended through first sliding slots 321 of base 3 and holes 423 of link 42. When pin 55 slides along first sliding slots 321, link 42 moves along first axis X and causes latch 41 to move between the latching position and the unlatching position.

According to the form shown, follower plate 5A is mounted between first and second sidewalls 32 of base 3. Follower plate 5A is substantially U-shaped and includes first and second sidewalls 52 spaced along second axis Y and an intermediate portion 51 extending between first and second sidewalls 52. Latch bolt 4 is movably received between first and second sidewalls 52 of follower plate 5A. A tab or projection 511 is formed on intermediate portion 51. A spring 57 is attached between projection 511 of follower plate 5A and protrusion 314 of base 3 to bias follower plate 5A. First and second sidewalls 52 include aligned holes 521 in first ends 53 thereof and aligned slots 522 in second ends 54 thereof. Each of first and second sidewalls 52 further includes an engaging notch 524A in the form shown as a stepped portion adjacent first end 53 thereof. Each of first and second sidewalls 52 further includes a restraining slot 523A between hole 521 and slot 522. Restraining slot 523A of each of first and second sidewalls 52 includes upper and lower edges 523C and 523D spaced along first axis X and parallel, spaced, first and second lateral edges 523E and 523F extending between upper and lower edges 5234C and 523D, with an upper end of upper edge 523C connected to an upper end of first lateral edge 523E, with a lower end of upper edge 523C connected to an upper end of second lateral edge 523F and located between upper and lower ends of first lateral edge 523E along first axis X, and with first and second lateral edges 523E and 523F substantially parallel to vertical sections 327 of first guiding slots 323 of base 3 of bottom latch 25. First lateral edge 523E has a length along first axis X larger than a length of second lateral edge 523F along first axis X. Upper edge 523C is substantially parallel to inclined section 328 of each first guiding slot 323 of base 3. Lower edge 523D has an arcuate protrusion. An arcuate first corner 523G is formed between a lower end of second lateral edge 523F and an end of lower edge 523D. An arcuate second corner 523H is formed between the upper end of upper edge 523C and the upper end of first lateral edge 523E. An arcuate third corner 5231 is formed between a lower end of first lateral edge 523E and the other end of lower edge 523D. First and third corners 523G and 5231 are located on opposite sides of the protrusion of lower edge 523D along third axis Z. A spacing between first corner 523G and second corner 523H along first axis X is substantially equal to a spacing between third corner 5231 and second corner 523H along first axis X. Note that each restraining slot 523A is located between the corresponding engaging notch 524A and intermediate portion 51 of follower plate 5A along third axis Z and that each slot 522 of follower plate 5A extends in a direction parallel to first and second lateral edges 523E and 523F.

In the form shown, each of first and second sidewalls 52 of follower plate 5A of bottom latch 25 further includes an engagement hole 525A between slot 522 and engaging notch 524A. Engagement hole 525A is substantially a portion of a circle in cross section and is spaced from inclined slot 523 along third axis Z. Pin 55 is parallel to pins 43 and 44 and extended through first sliding slots 321 of base 3, holes 521 of follower plate 5, and holes 423 of link 42. Thus, an end of the follower plate 5 is pivotably connected to second end 422 of link 42. Note that pin 43 is extended through pin holes 329 of first and second sidewalls 32 of base 3 and first pivotal portion 411 and that pin 44 is extended through holes 425 of link 42 and second pivotal portion 412 of latch 41.

According to the form shown, locking device 7 includes a safety plate 71A, a positioning pin 72, and a spring 74 in the form shown as a tension spring. Safety plate 71A is movably received between first and second sidewalls 52 of follower plate 5A and includes two sidewalls 712 spaced along second axis Y and interconnected by an interconnecting section 711. Each sidewall 712 includes first and second ends 713 and 714. Aligned holes 717 are defined in second ends 714 of sidewalls 712. Sidewalls 712 further include aligned holes 716 between first and second ends 713 and 714 thereof. Pin 56 is extended through second sliding slots 322 of base 3, slots 522 of follower plate 5A, holes 717 of safety plate 71A, and transverse hole 611 of first end 61 of linking rod 6. Thus, follower plate 5A can be moved along first axis X together with linking rod 6 to move latch 41 of bottom latch 25 between the unlatching position and the latching position. Furthermore, safety plate 71A can move along first axis X together with linking rod 6. A pin 73 is extended through first guiding slots 323 of base 3, restraining slots 523A of follower plate 5A, and holes 716 of safety plate 71A. Follower plate 5A can move relative to pin 73 along first axis X through a distance substantially the same as the spacing between the second and third corners 523H and 5231. When pin 73 is moving between first and second lateral edges 523E and 523F of each restraining slot 523A and along vertical sections 327 and inclined sections 328 of first guiding slots 323, safety plate 71A pivots about a pivot axis defined by pin 56 while moving upward or downward along first axis X. Pivotal movement of safety plate 71A is limited due to the limitation to pin 73 of safety plate 71A by restraining slots 523A of follower plate 5A and first guiding slots 323 of base 3.

Locking device 7 is mounted on base 3 to lock latch 41 in the latching position or the unlatching position. Due to provision of locking device 7, top latch 24 and bottom latch 25 can be unlatched only when touch bar 22 is pressed. A deadlocking effect is, thus, provided.

According to the form shown, locking device 7 includes a safety plate 71A, a positioning pin 72, and a spring 74 in the form shown as a tension spring. Safety plate 71A is movably received between first and second sidewalls 52 of follower plate 5A and includes two sidewalls 712 spaced along second axis Y and interconnected by an interconnecting section 711. Each sidewall 712 includes first and second ends 713 and 714. Aligned holes 717 are defined in second ends 714 of sidewalls 712. Sidewalls 712 further include aligned holes 716 between first and second ends 713 and 714 thereof. Pin 56 is extended through second sliding slots 322 of base 3, slots 522 of follower plate 5A, holes 717 of safety plate 71A, and transverse hole 611 of first end 61 of linking rod 6. Thus, follower plate 5A can be moved along first axis X together with linking rod 6 to move latch 41 of bottom latch 25 between the unlatching position and the latching position. Furthermore, safety plate 71A can move along first axis X together with linking rod 6. A pin 73 is extended through first guiding slots 323 of base 3, restraining slots 523A of follower plate 5A, and holes 716 of safety plate 71A. Follower plate 5A can move relative to pin 73 along first axis X through a distance substantially the same as the spacing between the second and third corners 523H and 5231. When pin 73 is moving between first and second lateral edges 523E and 523F of each restraining slot 523A and along vertical sections 327 and inclined sections 328 of first guiding slots 323, safety plate 71A pivots about a pivot axis defined by pin 56 while moving upward or downward along first axis X. Pivotal movement of safety plate 71 A is limited due to limitation to pin 73 of safety plate 71A by restraining slots 523A of follower plate 5A and first guiding slots 323 of base 3.

According to the form shown, each sidewall 712 of safety plate 71A further includes an engaging notch 715 and a lug 718 between engaging notch 715 and second end 714. Lugs 718 are aligned along second axis Y and include aligned holes 719. Engaging notches 715 can engage with positioning pin 72 (FIG. 4) or disengage from positioning pin 72 (FIGS. 4A and 6) through pivotal movement of safety plate 71A. Positioning pin 72 is extended through second guiding slots 324 of base 3 and movable between two ends of each second guiding slot 324. Spring 74 includes a first end 741 attached to positioning pin 72 and a second end 742 attached to pin 73 to bias positioning pin 72 and pin 73 towards each other. Thus, the follower plate 5A and the latch bolt 4 are biased toward main section 31 of base 3 to engage positioning pin 72 in engaging notches 715 of safety plate 71A.

Figure 2:
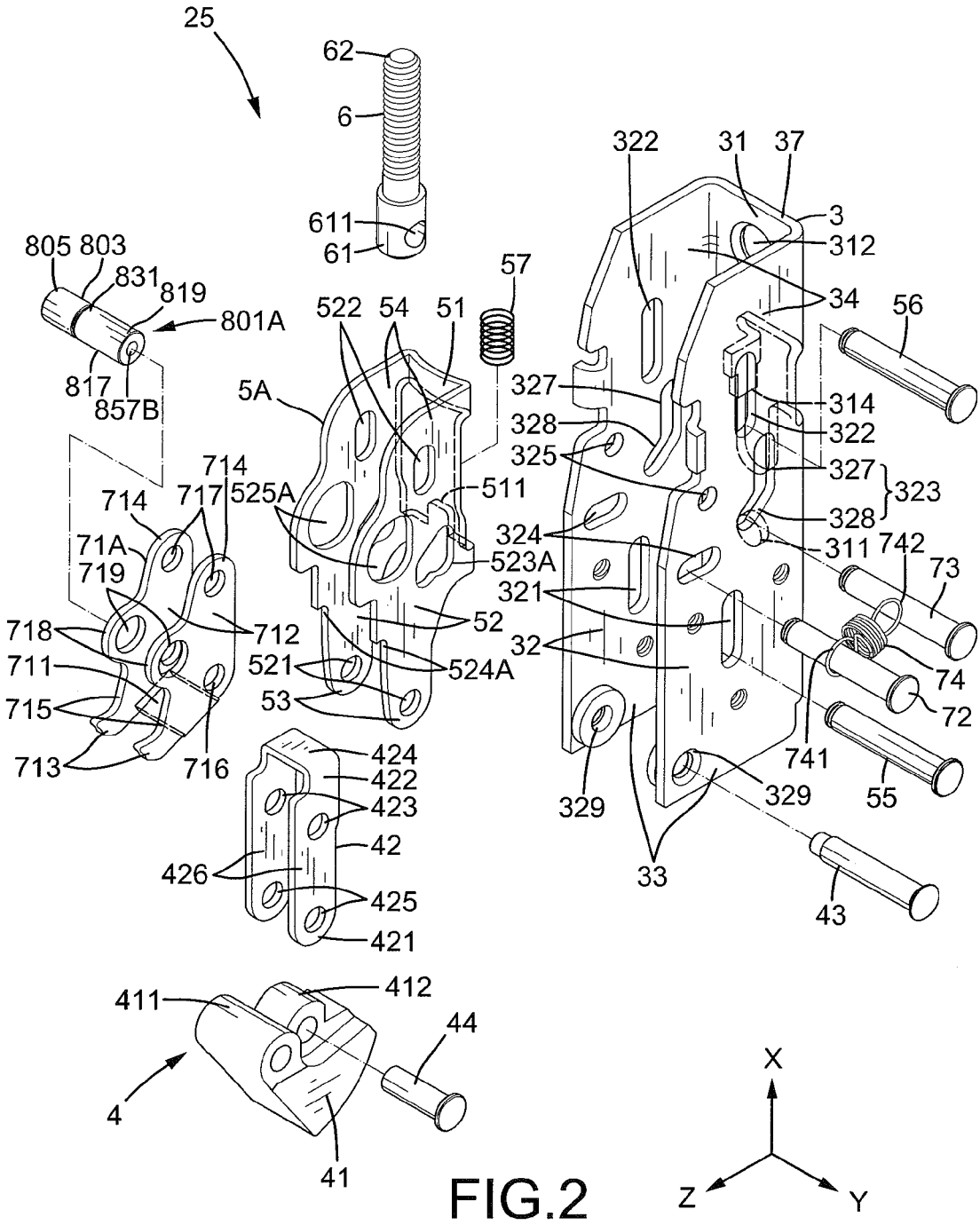
FIG. 2 shows an exploded perspective view of a bottom latch of the door lock of FIG. 1.
Figure 4:
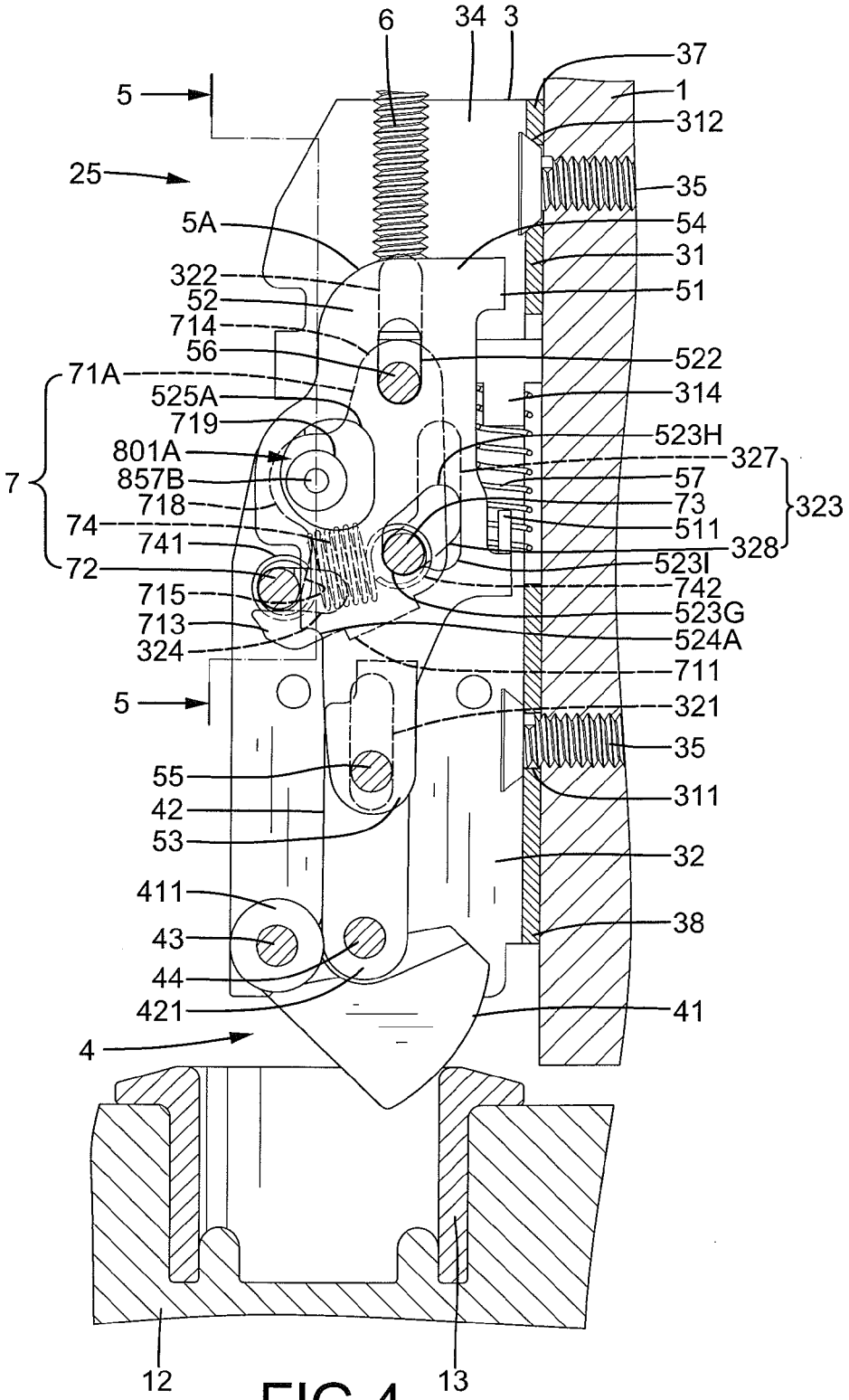
FIG. 4 shows a partial, cross-sectional view taken along section line 4-4 of FIG. 1, with a latch bolt of the bottom latch in a latching position.

Bottom latch 25 utilizing the latch assembly of FIG. 2 is shown in FIGS. 1 and 4. When latch 41 is in the latching position outside base 3 (FIG. 4), latch 41 is stopped by a strike 13 on the ground 12. Door 1 is, thus, locked, with positioning pin 72 engaged in engaging notches 715 of safety plate 71A. Thus, latch 41 can not be moved from the latching position to the unlatching position. Specifically, when latch 41 of top latch 24 is pivoted through a small angle due to picking, link 42, follower plate 5A, and safety plate 71A jointly move upward through a small travel along first axis X. Since positioning pin 72 is engaged in engaging notches 715 of safety plate 71A, the travel of follower plate 5A along first axis X is insufficient to move latch 41 from the latching position to the unlatching position, providing an anti-picking function. Note that spring 74 biases positioning pin 72 and pin 73 toward each other to retain positioning pin 72 in engaging notches 715 of safety plate 71.

Figure 4A:
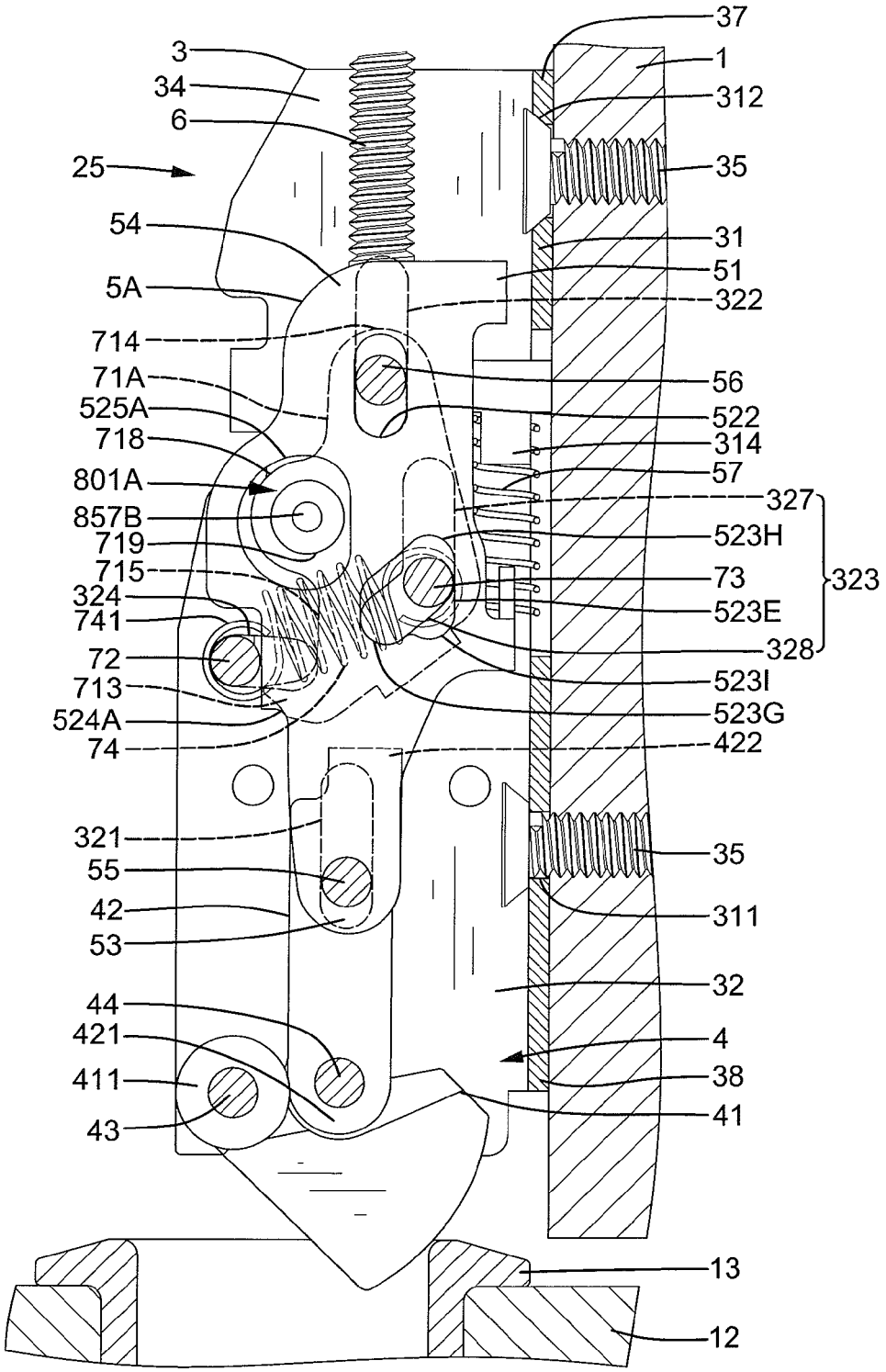
FIG. 4A shows a view similar to FIG. 4, with a linking rod moved to disengage a safety plate of the bottom latch from a positioning pin.

When touch bar 22 is pressed, follower plate 5A is not moved when lower vertical rod 232 and linking rod 6 are moved upward away from latch 41 through a travel slightly smaller than a length of slot 522 of follower plate 5A along first axis X, but safety plate 71A moves away from latch 41 along first axis X relative to follower plate 5A. First ends 713 of safety plate 71A are actuated by pin 73 to cause pivotal movement of engaging notches 715 away from positioning pin 72. Pin 73 also moves toward second corners 523H of restraining slots 523A. When pin 73 reaches an intersection between vertical section 327 and inclined section 328 of each first guiding slot 323, pin 73 abuts first lateral side 523E and is between second and third corners 523H and 523I (FIG. 4A). Furthermore, engaging notches 715 of safety plate 71A completely disengage from positioning pin 72. Thus, latch 41 can move from the latching position to the unlatching position. During disengagement of engaging notches 715 of safety plate 71A from positioning pin 72, follower plate 5A does not move along first axis (see FIGS. 4 and 4A). This is because the travel of pin 56 actuated by linking rod 6 along first axis X is smaller than the length of slots 522 along first axis X.

Figure 6:
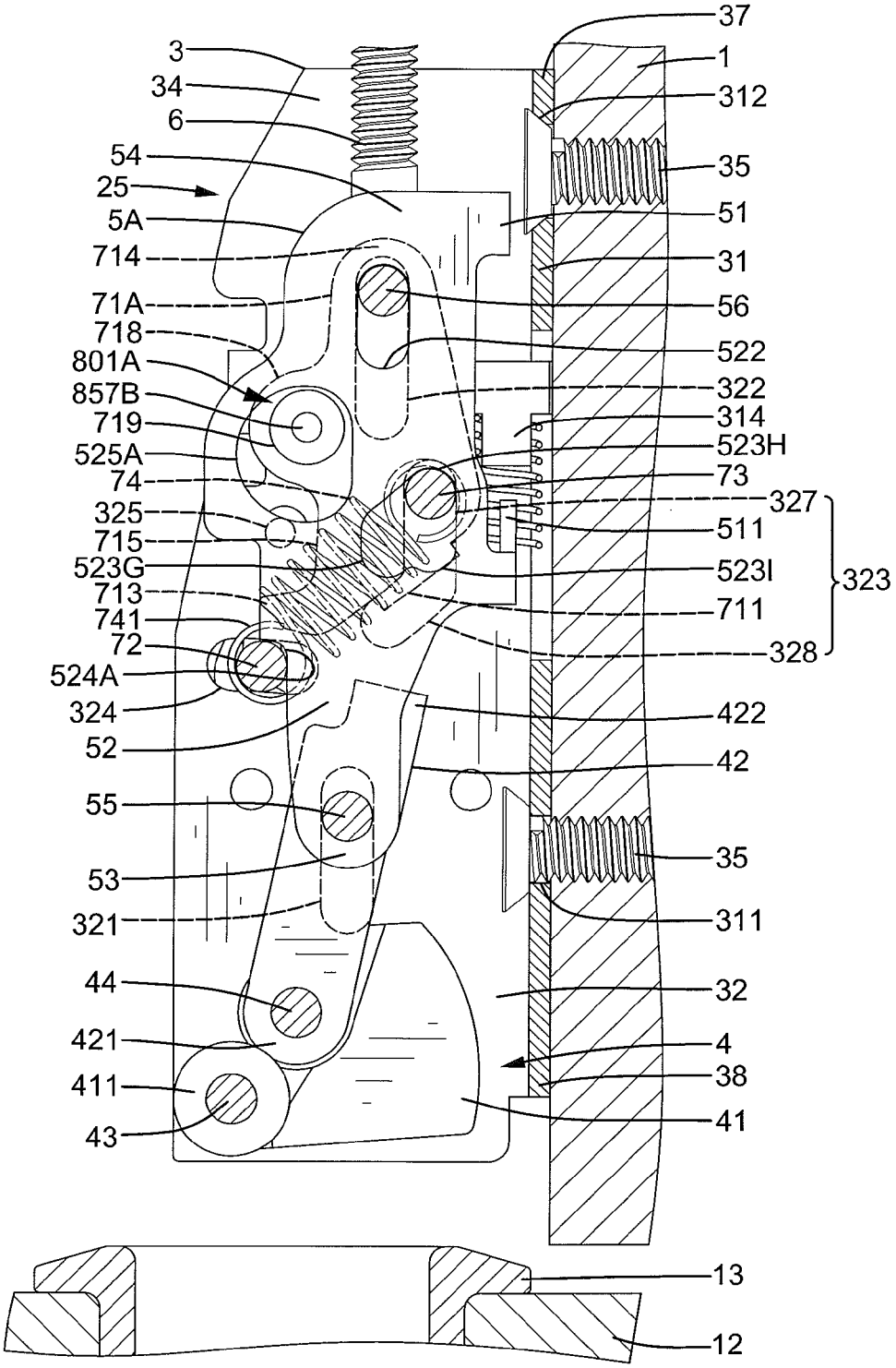
FIG. 6 shows a view similar to FIG. 4, with the latch bolt of the bottom latch in an unlatching position.

After pin 56 reaches upper ends of slots 522, pin 73 is located in vertical sections 327 of first guiding slots 323 and adjacent to vertical sections 327, and first ends 713 of safety plate 71A are located on a side of positioning pin 72. In this case, further upward movement of linking rod 6 away from latch 41 along first axis X causes follower plate 5A to move upward together with linking rod 6, which in turn, causes upward pivotal movement of link 42 about the pivot axis defined by pin 44. When pin 56 reaches the upper ends of second sliding slots 322, pin 73 is located in second corners 523H of restraining slots 523A and in distal ends of vertical sections 327 of first guiding slots 323 (FIG. 6). Link 42 pivots about the pivot axis defined by pin 55 to cause pivotal movement of follower plate 5A that compresses spring 57. Latch 41 is moved to the unlatching position (FIG. 6) in base 3 and is disengaged from strike 13.

When latch 41 of bottom latch 25 is in the unlatching position, positioning pin 72 is biased by spring 74 to engage with engaging notches 524A of follower plate 5A so that follower plate 5A can not move towards latch 41 along first axis X, reliably retaining latch 41 in the unlatching position. This effectively avoids latch 41 of bottom latch 25 from extending outside of base 3 due to the backlashes of the parts of bottom latch 25 after assembly. As a result, the interference between latch 41 and the ground 12 while door lock 2 is unlatched can be effectively avoided. It can be appreciated that the idle travel of pin 56 in slots 522 of follower plate 5A provides a burglarproof effect. Particularly, when latch 41 of top latch 24 is pivoted through a small angle due to picking, upward movement of link 42 and follower plate 5A along first axis X is smaller than or equal to the length of slots 522 along first axis X without causing unlatching of latch bolt 4.

Figure 6A:
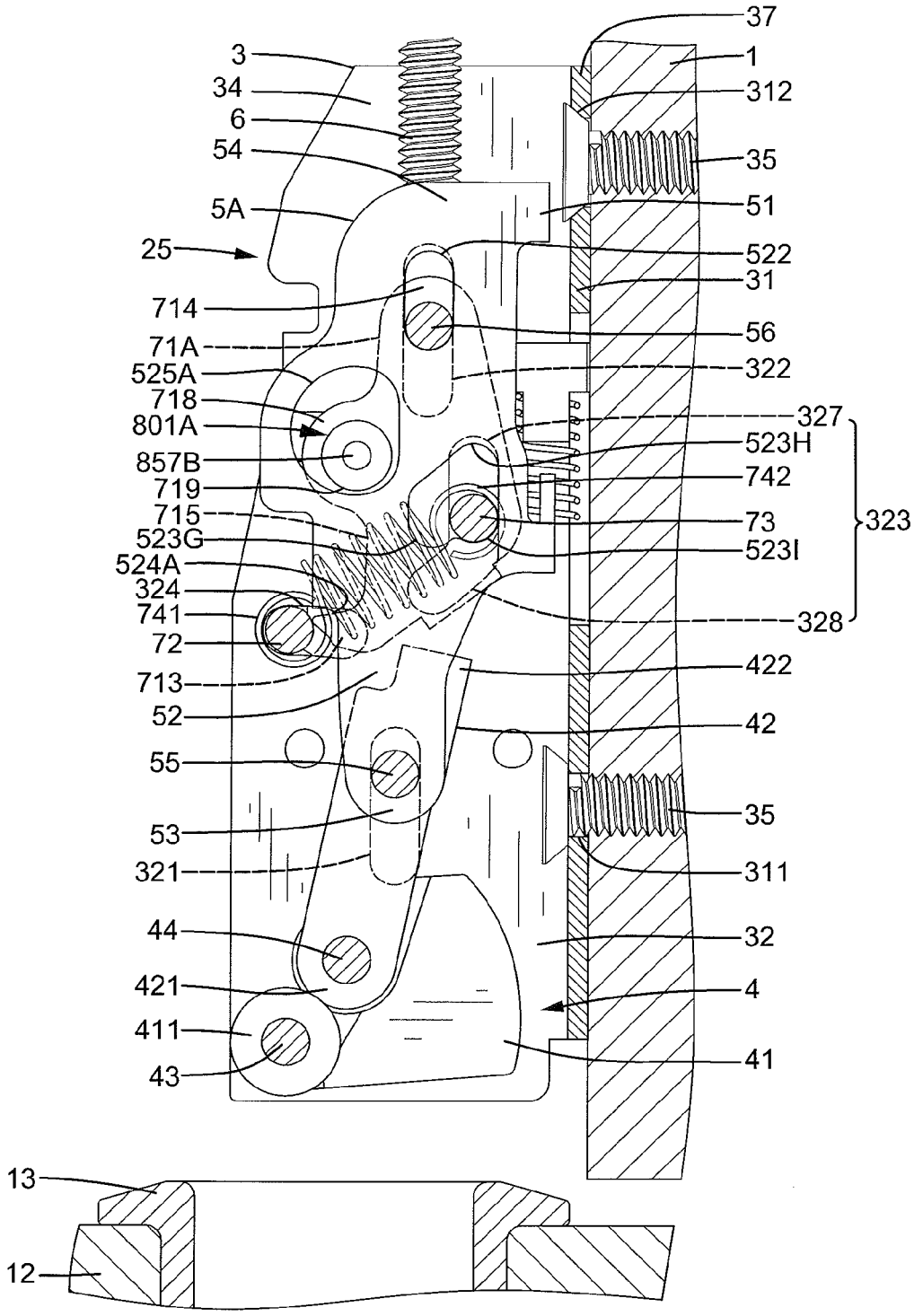
FIG. 6A shows a view similar to FIG. 6, with the linking rod moved in the unlatching direction, with the positioning pin pushed away from a base of the bottom latch by the safety plate.
Figure 7:
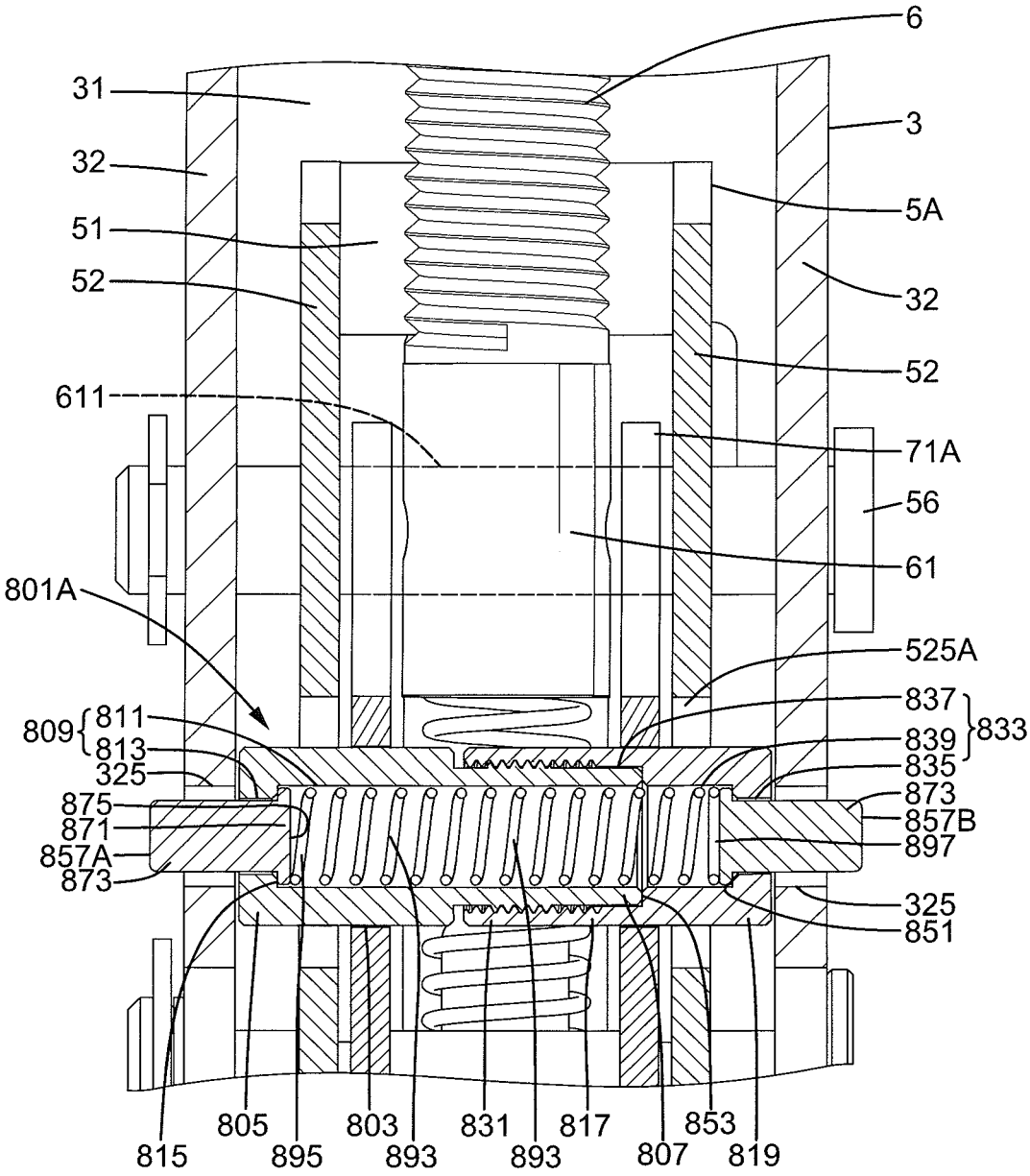
FIG. 7 shows a view similar to FIG. 5, with a safety pin of the safety device for the bottom latch in an extended position.

When touch bar 22 is released, linking rod 6 returns to its original position, and pin 56 moves towards latch 41 of bottom latch 25 along first axis X through a travel substantially the same as the length of slots 522 of follower plate 5A along first axis X (FIG. 6A). Pin 73 moves along vertical sections 327 of first guiding slots 323 into third corners 5231 of restraining slots 523A, causing safety plate 71A to move relative to follower plate 51A towards latch 41 along first axis X. When pin 56 is located in lower ends of slots 522 and pin 73 is located in third corners 523I of restraining slots 523A, first ends 713 of safety plate 71A push and, thus, disengage positioning pin 72 from engaging notches 524A (FIG. 6A). Then, spring 57 biases follower plate 5A and causes joint movement of follower plate 5A and safety plate 71A towards latch 41 along first axis X, moving latch 41 from the unlatching position (FIG. 6) to the latching position (FIG. 4). Safety plate 71A is actuated by pin 73. Due to provision of inclined sections 328 of first guiding slots 323, engaging notches 715 reengage with positioning pin 72 after first ends 713 of safety plate 71A move across positioning pin 72.

Figure 3:
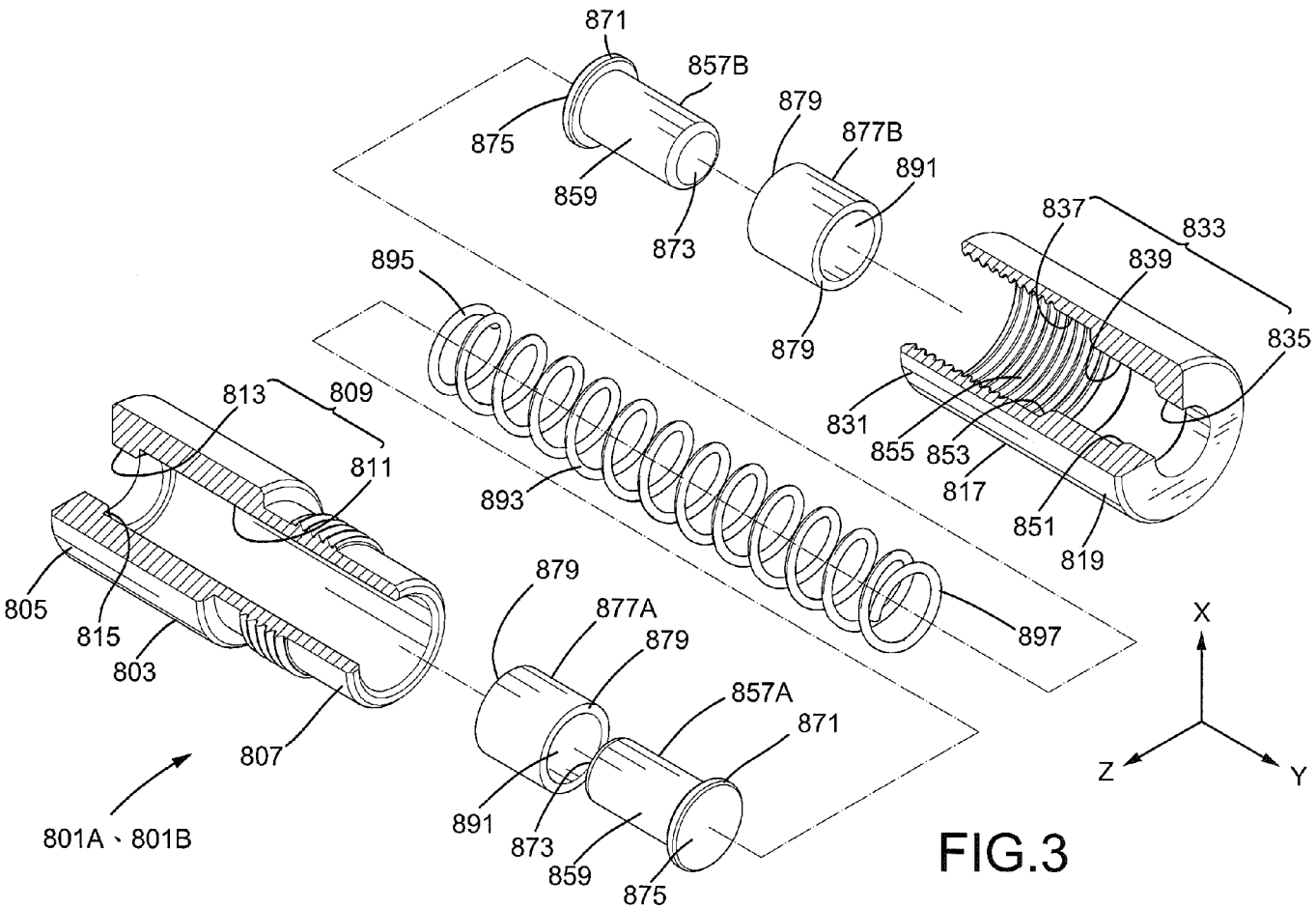
FIG. 3 shows an exploded, perspective view of a safety device of the bottom latch of FIG. 2.

According to the form shown, the latch assembly further includes a first safety device 801A (FIGS. 2 and 3) mounted in follower plate 5 of bottom latch 25. First safety device 801A includes first and second sleeves 803 and 817 engaged with each other. First sleeve 803 includes a first end 805 and a second end 807 spaced from first end 805 along second axis Y and having a diameter smaller than that of first end 805. A receiving hole 809 extends from first end 805 through second end 807. Receiving hole 809 includes a smaller section 813 extending from first end 805 towards but spaced from second end 807 and a larger section 811 extending from second end 807 through smaller section 813 and having a diameter larger than smaller section 813, with a shoulder 815 formed in an intersection of larger and smaller sections 811 and 813. Second sleeve 817 includes a first end 819 and a second end 831 spaced from first end 819 along second axis Y. A mounting hole 833 extends from first end 819 through second end 831. Mounting hole 833 includes a first hole section 835 extending from first end 819 towards but spaced from second end 831, a second hole section 837 extending from second end 831 towards but spaced from first end 819, and an intermediate hole section 839 between first and second hole sections 835 and 837, with a first abutment face 851 formed at an intersection of first hole section 835 and intermediate hole section 839, and with a second abutment face 853 formed at an intersection of intermediate hole section 839 and second hole section 837. Second hole section 837 includes an inner threading 855 spaced from second abutment face 853.

Figure 5:
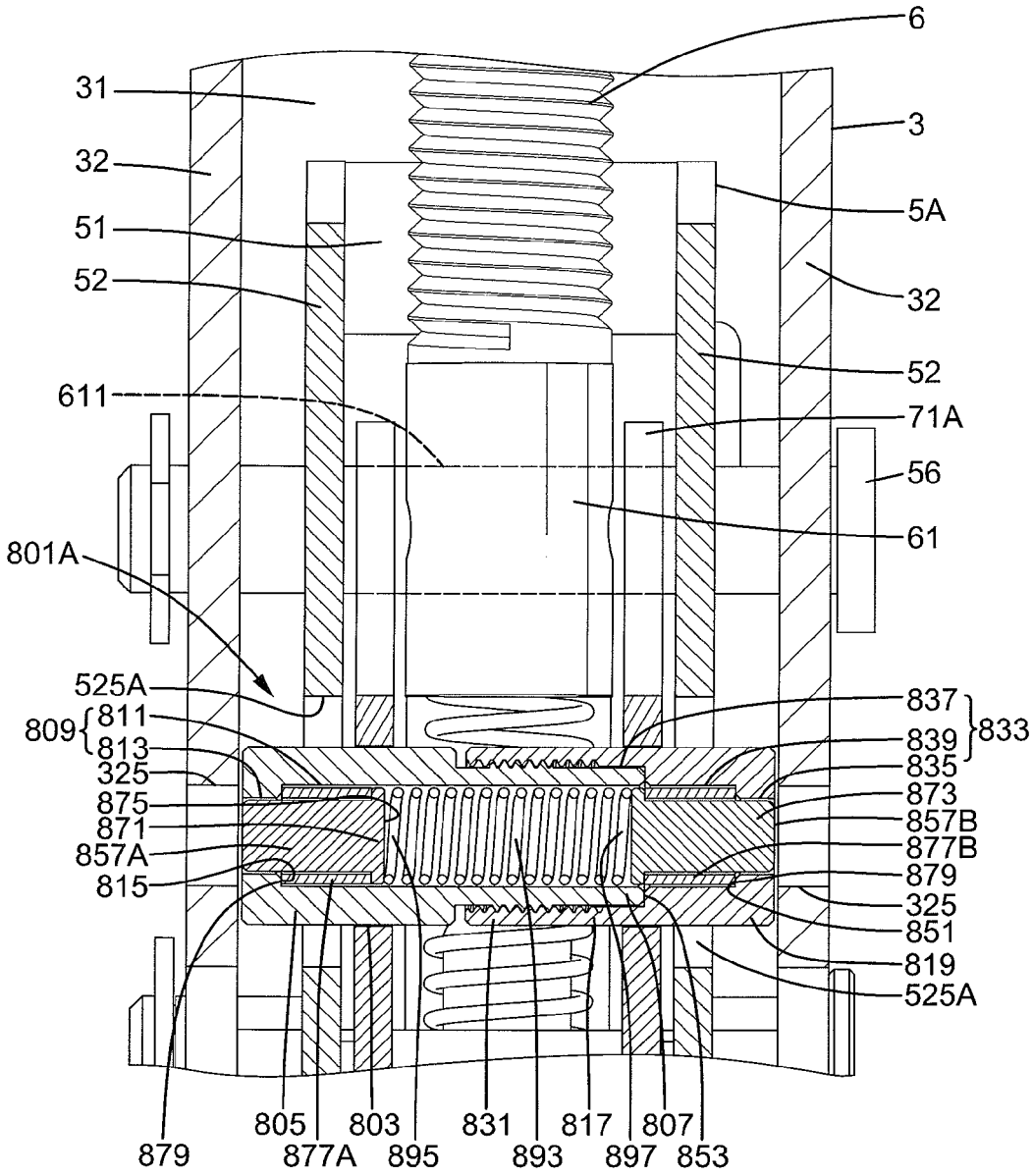
FIG. 5 shows a cross sectional view taken along section line 5-5 of FIG. 4.

Second end 807 of first sleeve 803 of first safety device 801A is threaded into second hole section 837 of second sleeve 817 and is engaged with inner threading 855. An end face of second end 807 of first sleeve 803 abuts second abutment face 853 of second sleeve 817 (FIG. 5). First end 805 of first sleeve 803 and first end 819 of second sleeve 817 respectively extend into engagement holes 525A of follower plate 5. Thus, first and second sleeves 803 and 817 can move jointly with follower plate 5.

According to the form shown, first safety device 801A further includes first and second stops 877A and 877B respectively mounted in first and second sleeves 803 and 817. First and second stops 877A and 877B are made of a material having a melting point lower than first and second sleeves 803 and 817, such as plastic. Each of first and second stops 877A and 877B has two ends 879 and a through-hole 891 extending from an end 879 through the other end 879. First stop 877A has an outer diameter slightly smaller than the inner diameter of larger section 811 of first sleeve 803. First stop 877A is received in larger section 811 of first stop 877A, with an end 879 abutting shoulder 815. Second stop 877B has an outer diameter smaller than the inner diameter of intermediate hole section 839 of second sleeve 817. Second stop 877B is received in intermediate hole section 839 of second sleeve 817, with an end 879 abutting first abutment face 851. A length of second stop 877B along second axis Y is equal to a length of intermediate hole section 839 of second sleeve 817. The melting point of each of first and second safety pins 857A and 857B is higher than that of first and second stops 877A and 877B.

According to the form shown, first safety device 801A further includes first and second safety pins 857A and 857B respectively mounted in first and second sleeves 803 and 817. Each of first and second safety pins 857A and 857B has a cylindrical shank 859 and a flange 871 on an end of shank 859, with flange 871 having an end face 875. Shank 859 further has a distal end 873 away from flange 871.

First safety pin 857A is mounted in receiving hole 809 of first sleeve 803, with shank 859 of first safety pin 857A extending through through-hole 891 of first stop 877A. A length of shank 859 along second axis is equal to a sum of a length of first stop 877A and a length of smaller section 813 of receiving hole 809 along second axis Y. An outer diameter of shank 859 of first safety pin 857A is slightly smaller than the inner diameter of smaller section 813 of receiving hole 809 of first sleeve 803 and slightly smaller than through-hole 891 of first stop 877A. An outer diameter of flange 871 of first safety pin 857A is slightly smaller than the inner diameter of larger section 811 of receiving hole 809 of first sleeve 803 but larger than the inner diameter of through-hole 891 of first stop 877A, such that flange 871 of first safety pin 857A abuts an end 879 of first stop 877A distant to shoulder 815. Furthermore, distal end 873 of shank 859 is extended through smaller section 813 of first sleeve 803, and an end face of distal end 873 of shank 859 of first safety pin 857A is flush with the end face of first end 805 of first sleeve 803.

Second safety pin 857B is mounted in mounting hole 833 of second sleeve 817. A length of shank 859 of second safety pin 857B along second axis Y is equal to the sum of a length of second stop 877B and a length of first hole section 835 of mounting hole 833 along second axis Y. An outer diameter of shank 859 of second safety pin 857B is slightly smaller than the inner diameter of first hole section 835 of mounting hole 833 of second sleeve 817 and slightly smaller than the inner diameter of through-hole 891 of second stop 877B. An outer diameter of flange 871 of second safety pin 857B is slightly smaller than the inner diameter of second hole section 837 of mounting hole 833 of second sleeve 817 but larger than the inner diameter of through-hole 891 of second stop 877B, such that flange 871 of second safety pin 857B abuts an end 879 of second stop 877B distant to first abutment face 851. Furthermore, distal end 873 of shank 859 of second safety pin 857B is extended through first hole section 835 of second sleeve 817, and an end face of distal end 873 of shank 859 of second safety pin 857B is flush with the end face of first end 819 of second sleeve 817.

According to the form shown, first safety device 801A further includes a safety spring 893 mounted in larger section 811 of first sleeve 803 and having first and second ends 895 and 897. First end 895 of safety spring 893 presses against end face 875 of first safety pin 857A, and second end 897 of safety spring 893 presses against end face 875 of second safety pin 857B (FIG. 5). Thus, safety spring 893 biases first safety pin 857A towards first sidewall 32 of base 3 and biases second safety pin 857B towards second sidewall 32 of base 3. However, first and second safety pins 857A and 857B are still stopped by first and second stops 877A and 877B, such that distal ends 873 of first and second safety pins 857A and 857B are in retracted positions in first and second sleeves 803 and 817 and, thus, can not extend beyond first and second sleeves 803 and 817. Namely, follower plate 5A can move along first axis X.

Base 3 of bottom latch 25 shown in FIGS. 1 and 4 is of a surfaced type. However, base 3 of bottom latch 25 can be mounted in an interior of door 1 such that the whole bottom latch 25 becomes a concealed-type bottom latch.

Figure 8:
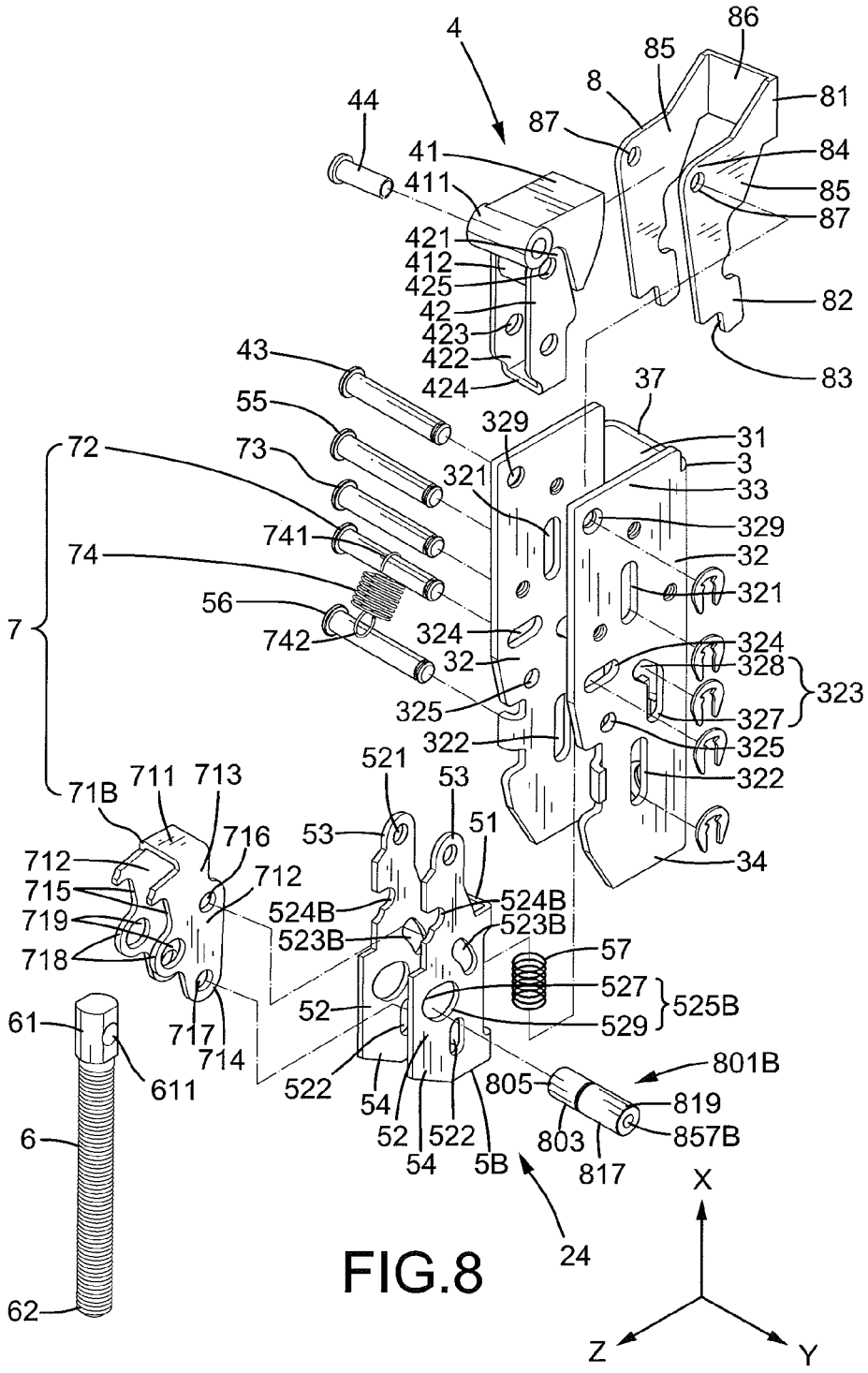
FIG. 8 shows an exploded, perspective view of a top latch of the door lock of FIG. 1.

After adding some parts, bottom latch 25 can form a surfaced-type top latch 24 for door lock 2. According to the form shown in FIG. 8, surfaced-type top latch 24 includes base 3, latch bolt 4, follower plate 5B, linking rod 6, and locking device 7 that form bottom latch 25 but arranged in an upsidedown manner. Top latch 24 further includes a second safety device 801B that is substantially identical to first safety device 801A. Like reference numerals designate like elements in top and bottom latches 24 and 25. Detailed description of these elements is not set forth to avoid redundancy. However, it is noted that second end 62 of linking rod 6 of top latch 24 is connected to upper end 234 of upper vertical rod 231. Furthermore, follower plate 5B of top latch 24 is substantially the same as follower plate 5A except that the shape of each engagement hole 525B of follower plate 5B of top latch 24 is in the form of a tear drop and includes a reduced end 527 and an enlarged end 529 and except that restraining slots 523B of follower plate 5B of top latch 24 are inclined, arcuate grooves (FIG. 8).

According to the form shown, locking device 7 of top latch 24 includes a safety plate 71B that is substantially the same as safety plate 71A except that the shape of safety plate 71B is slightly different from that of safety plate 71A. First end 805 of first sleeve 803 and first end 819 of second sleeve 817 of second safety device 801B respectively extend through holes 719 of lugs 718 of safety plate 71B into engagement holes 525B of follower plate 5B of top latch 24. Thus, follower plate 5B can move together with linking rod 6 along first axis X to allow movement of latch 41 between the latching position and the unlatching position. Furthermore, safety plate 71B can move jointly with linking rod 6 or move jointly with follower plate 5B. Pin 73 of top latch 24 extends through first guiding slots 323 of base 3, restraining slots 523B of follower plate 5B and holes 716 of safety plate 71B. When pin 73 is moving between first and second lateral edges 523E and 523F of each restraining slot 523B and along vertical sections 327 and inclined sections 328 of first guiding slots 323, safety plate 71B pivots about a pivot axis defined by pin 56 while moving upward or downward along first axis X. Pivotal movement of safety plate 71B is limited due to the limitation to pin 73 of safety plate 71B by restraining slots 523B of follower plate 5B and first guiding slots 323 of base 3.

According to the form shown, top latch 24 further includes a guard plate 8 mounted between first ends 33 of first and second sidewalls 32 of base 3. Guard plate 8 includes two sidewalls 85 spaced along second axis Y and interconnected by an interconnecting section 86 therebetween. Each sidewall 85 includes first and second ends 81 and 82 and aligned holes 87 between first and second ends 81 and 82, providing a pivotal portion 84 between first and second ends 81 and 82 of each sidewall 85. Pin 43 is extended through pin holes 329 of base 3, first pivotal portion 411 of latch bolt 4, and holes 87 of guard plate 8, allowing first ends 81 of sidewalls 85 and interconnecting section 86 interconnected between first ends 81 to pivot outside base 3. Second end 82 of each sidewall 85 has a notch 83 that can be in contact with and movable together with positioning pin 72 of locking device 7.

Figure 9:
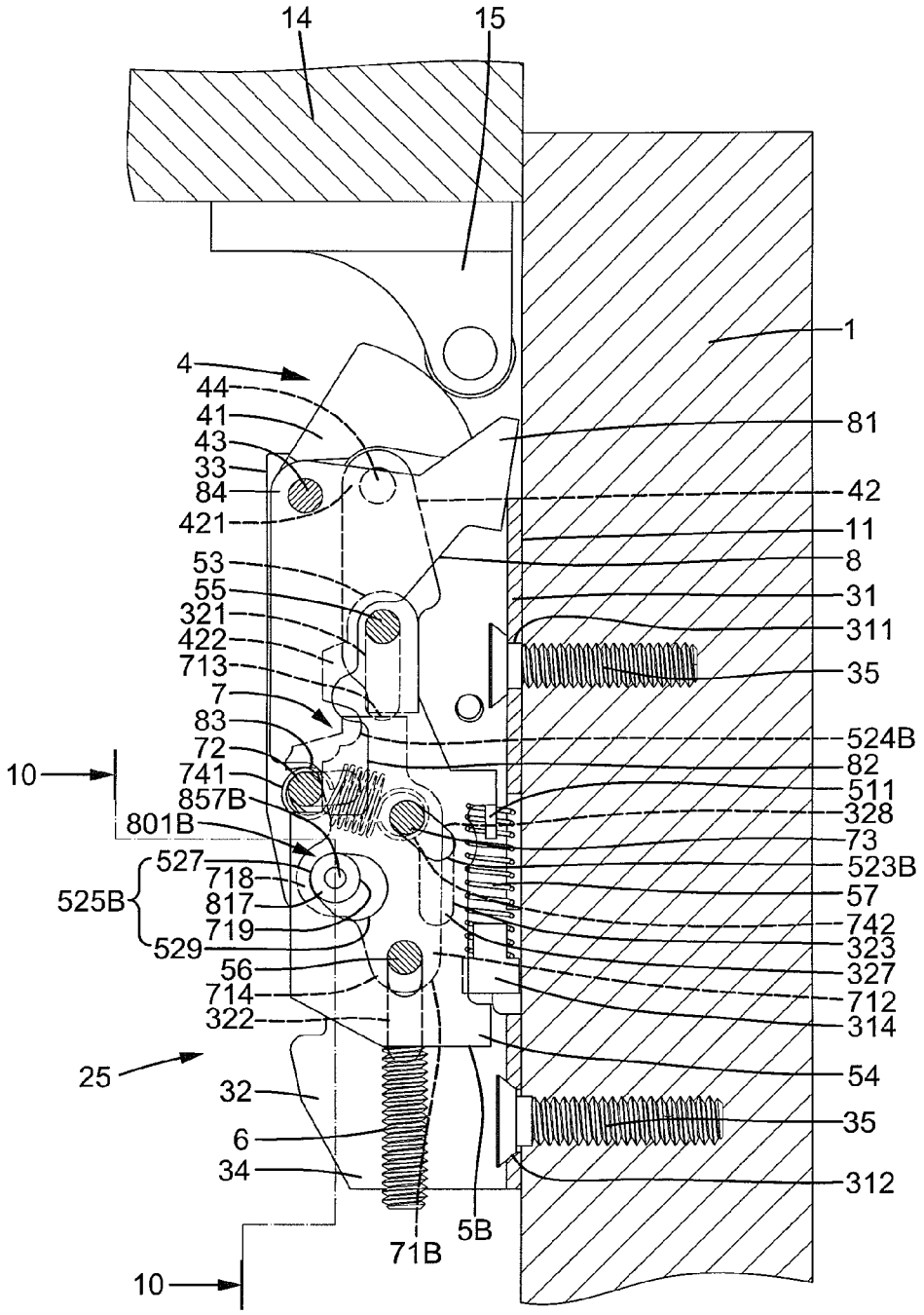
FIG. 9 shows a partial, cross-sectional view taken along section line 9-9 of FIG. 1, with a latch bolt of the top latch in a latching position.

With reference to FIG. 9, when latch 41 of latch bolt 4 is in the latching position outside base 3, latch 41 of top latch 24 is stopped by a strike 15 on an upper beam 14 of a door frame. Door 1 is, thus, locked. In this case, first and second safety pins 857A and 857B of second safety device 801B are aligned with positioning holes 325 of base 3 of top latch 24, and positioning pin 72 is engaged with engaging notches 715 of safety plate 71 B to lock latch 41 in the latching position. When latch 41 of top latch 24 is pivoted through a small angle due to picking, link 42, follower plate 5, and safety plate 71B jointly move downward through a small travel along first axis X. Since positioning pin 72 is engaged in engaging notches 715 of safety plate 71B, the travel of follower plate 5 along first axis X is insufficient to move latch 41 from the latching position to the unlatching position, providing an anti-picking function. Note that spring 74 biases positioning pin 72 and pin 73 toward each other to retain positioning pin 72 in engaging notches 715 of safety plate 71B.

Figure 11:
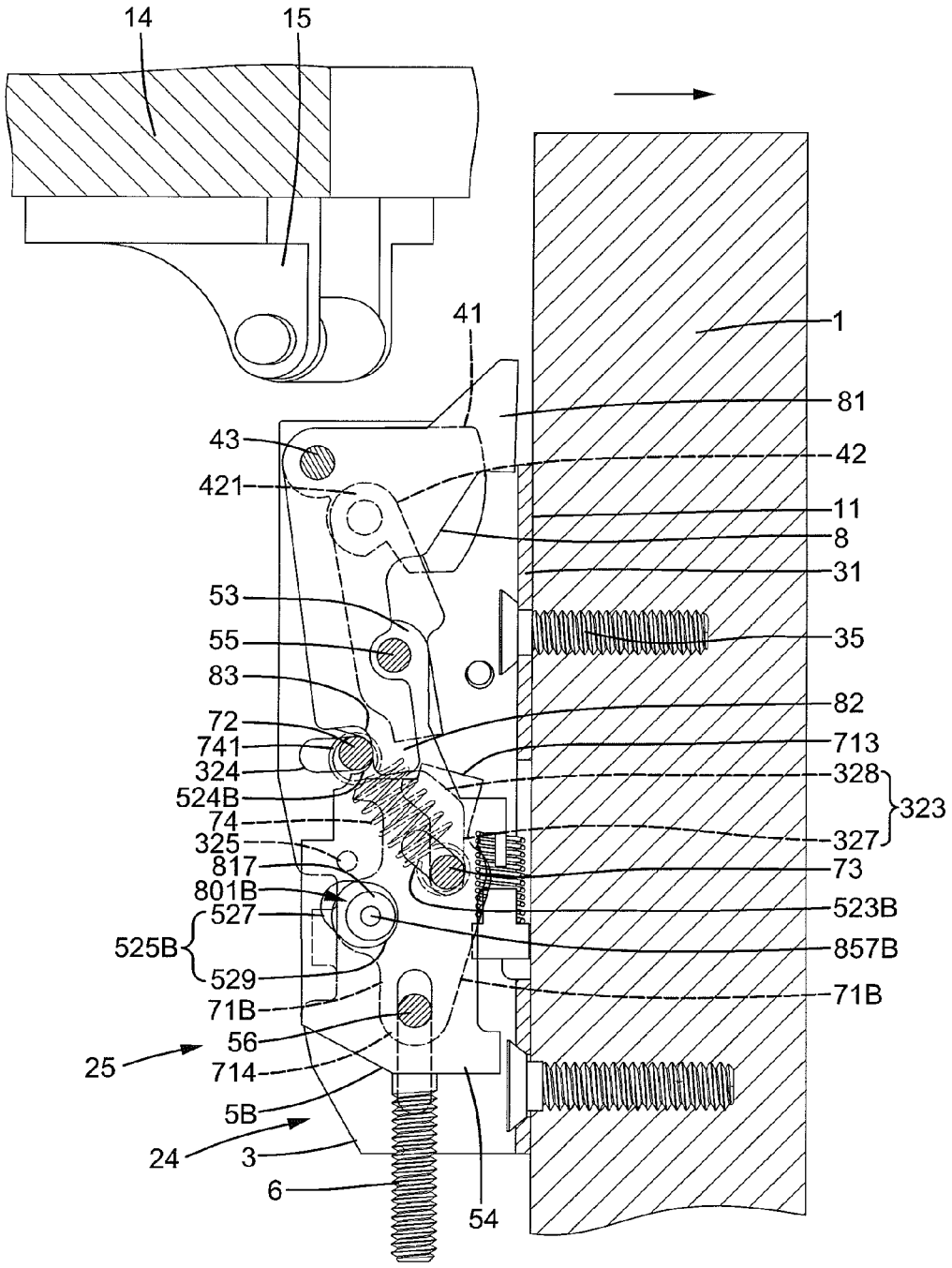
FIG. 11 shows a view similar to FIG. 9, with the latch bolt of the top latch in an unlatching position, and with the door opened.

When the touch bar 22 is pressed to move upper vertical rod 231 downward and to move lower vertical rod 232 upward along first axis X, linking rod 6 carries safety plate 71B downward along first axis X away from latch 41. Pin 56 does not actuate follower plate 5B when the travel of pin 56 along first axis X is smaller than the length of slots 522 of follower plate 5B along first axis X. Second safety device 801B moves together with safety plate 71B. First end 805 of first sleeve 803 and first end 819 of second sleeve 817 of second safety device 801B move from reduced ends 527 to enlarged ends 529 of engagement holes 525B of follower plate 5B. When pin 73 reaches an intersection of vertical sections 327 and inclined section 328 of each first guiding slot 323 of base 3, pin 73 is located in an end of each restraining slot 523B of follower plate 5B. Safety plate 71B pivots about the pivot axis defined by pin 56 to disengage engaging notches 715 of safety plate 71B from positioning pin 72 while pin 73 is moving along restraining slots 523B. Thus, when linking rod 6 continues moving away from latch 41 of top latch 24 and actuates pin 56, pin 56 presses against a wall of each slot 522, causing follower plate 5B to move away from latch 41 of top latch 24, moving latch 41 from the latching position to the unlatching position. At the same time, follower plate 5B, safety plate 71B and second safety device 801B move jointly away from latch 41 of top latch 24 until latch 41 reaches its unlatching position. When latch 41 of top latch 24 is in the unlatching position, first end 805 of first sleeve 803 and first end 819 of second sleeve 817 of second safety device 801B are in enlarged ends 529 of engagement holes 525B of follower plate 5B. When pin 73 is in distal ends of vertical sections 327 of first guiding slots 323, latch 41 is in the unlatching position, and first and second safety pins 857A and 857B of second safety device 801B are not aligned with positioning holes 325 of base 3 of top latch 24 (FIG. 11). With reference to FIG. 11, when latch 41 of top latch 24 is in the unlatching position, positioning pin 72 is engaged in engaging notches 524B of follower plate 5B, preventing follower plate 5B from moving upward along first axis X. Thus, latch 41 is retained in the unlatching position so that the latch 41 does not extend beyond the base 3 to interrupt closing of the door 1.

When latch 41 of top latch 24 is retained in the latching position, release of touch bar 22 of door lock 2 can not return latch 41 of bottom latch 25 to its latching position. Specifically, when latch 41 of top latch 24 is retained in the latching position, follower plate 5B can not move along first axis X, such that linking rod 6 of top latch 24 and upper vertical rod 231 can not move along first axis X, either. In this case, when touch bar 22 is released, the transmission mechanism of door lock 2 can not move lower vertical rod 232, retaining latch 41 of bottom latch 25 in its latching position. When door 1 is closed and, thus, causes movement of latch 41 of top latch 24 from the unlatching position to the latching position, the transmission mechanism of door lock 2 actuates bottom latch 25, causing safety plate 71A to disengage positioning pin 72 of bottom latch 25 from engaging notches 715 of safety plate 71A. In this case, latch 41 of bottom latch 25 returns to its latching position together with latch 41 of top latch 24.

Figure 12:
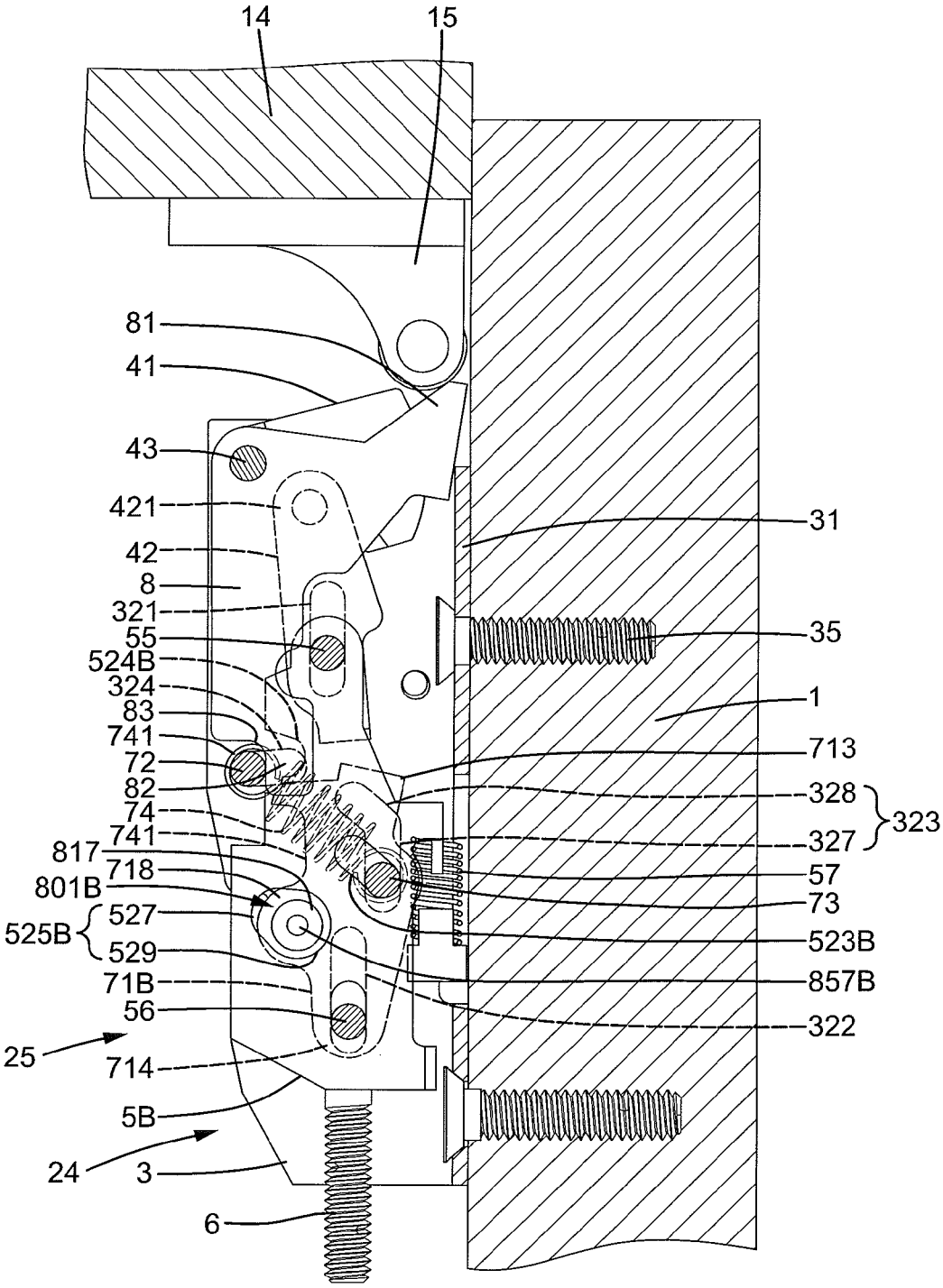
FIG. 12 shows a view similar to FIG. 11, with the latch bolt of the top latch about to move from the unlatching position to the latching position.
Figure 13:
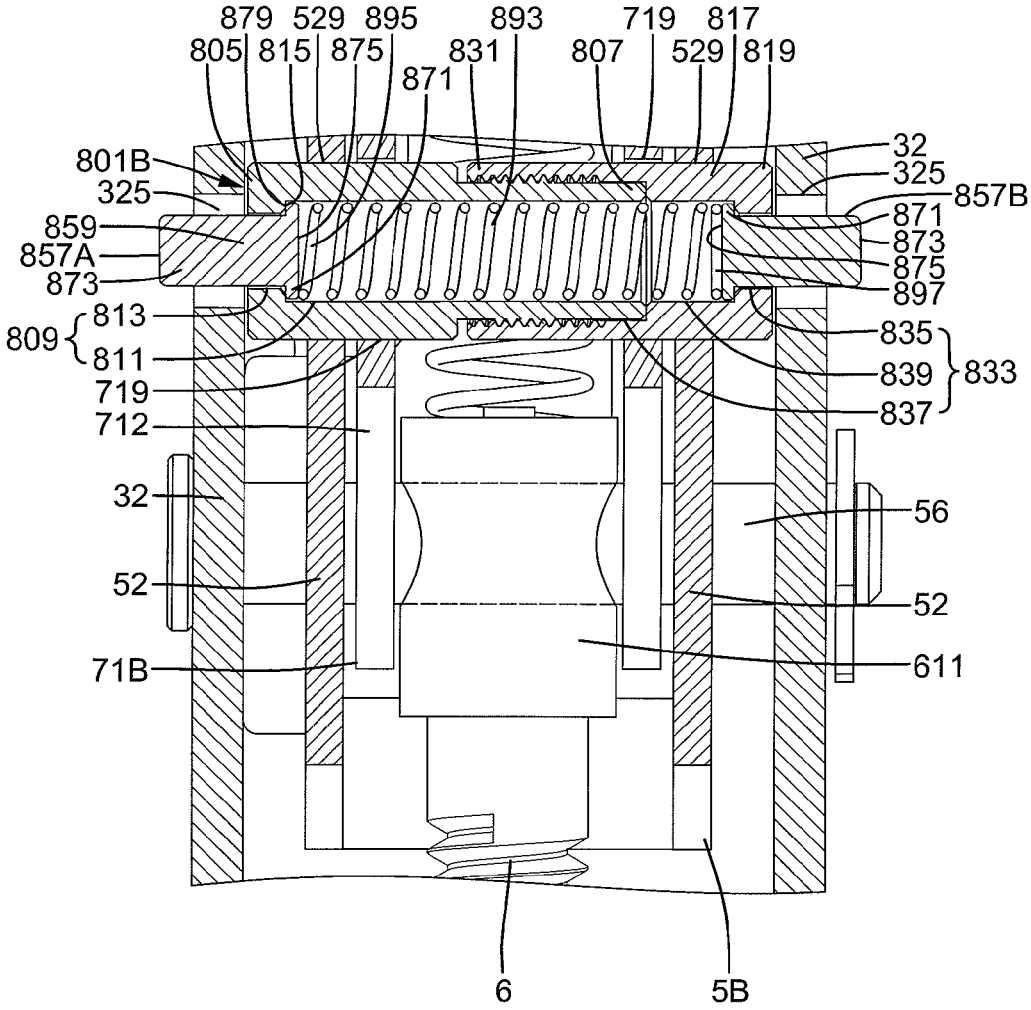
FIG. 13 shows a view similar to FIG. 10, with a safety pin of the safety device for the top latch in an extended position.

When closing door 1 in a state shown in FIG. 11, strike 15 presses against interconnecting section 86 between first ends 81 of sidewalls 85 of guard plate 8 (FIG. 12). Guard plate 8 pushes positioning pin 72, disengaging positioning pin 72 from engaging notches 524B of follower plate 5B. Specifically, when first ends 81 of sidewalls 85 and/or interconnecting section 86 of guide plate 8 are impinged by strike 15 while closing door 1, second ends 82 of sidewalls 85 of guard plate 8 pivot towards positioning pin 72 and, thus, disengage positioning pin 72 from engaging notches 524B of follower plate 5B. Follower plate 5B is biased by spring 57 to move towards latch 41 of top latch 24 along first axis X, causing link 42 to move, which, in turn, moves latch 41 of top latch 24 from the unlatching position to the latching position. In this case, safety plate 71B is actuated by pin 56 and moves together with follower plate 5B and pin 73 towards latch 41 of top latch 24 along first axis X. First ends 713 of safety plate 71B can not pivot about the pivot axis defined by pin 56 when the travel of pin 73 along first axis X is smaller than a length of vertical sections 327 of first guiding slots 323 of base 3 along first axis X. When latch 41 of top latch 24 is moving from the unlatching position to the latching position, follower plate 5B, safety plate 71B, and second safety device 801B move jointly towards latch 41 of top latch 24 along first axis X until pin 73 reaches intersections of vertical sections 327 and inclined sections 328 of base 3. Follower plate 5B can not move further along first axis X towards latch 41 of top latch 24 when latch 41 of top latch 24 is in the latching position. However, second safety device 801B is actuated by second safety plate 71B, moving first end 805 of first sleeve 803 and first end 819 of second sleeve 817 of second safety device 801B from enlarged ends 529 to reduced ends 527 of engagement holes 525B of follower plate 5B (FIG. 9). Furthermore, when pin 73 reaches intersections of vertical sections 327 and inclined sections 328 of base 3, spring 74 pulls pin 73 to move along inclined sections 328 of base 3 and restraining slots 523B of follower plate 5B, causing first ends 713 of safety plate 71B to pivot about the pivot axis defined by pin 56. When pin 73 reaches distal ends of inclined sections 328 of top latch 24, positioning pin 72 of top latch 24 engages with engaging notches 715 of safety plate 71B, and latch 41 of top latch 24 is in the latching position. In this case, spring 74 pulls positioning pin 72 and pin 73 towards each other, retaining positioning pin 72 in engaging notches 715 of safety plate 71B.

Figure 10:
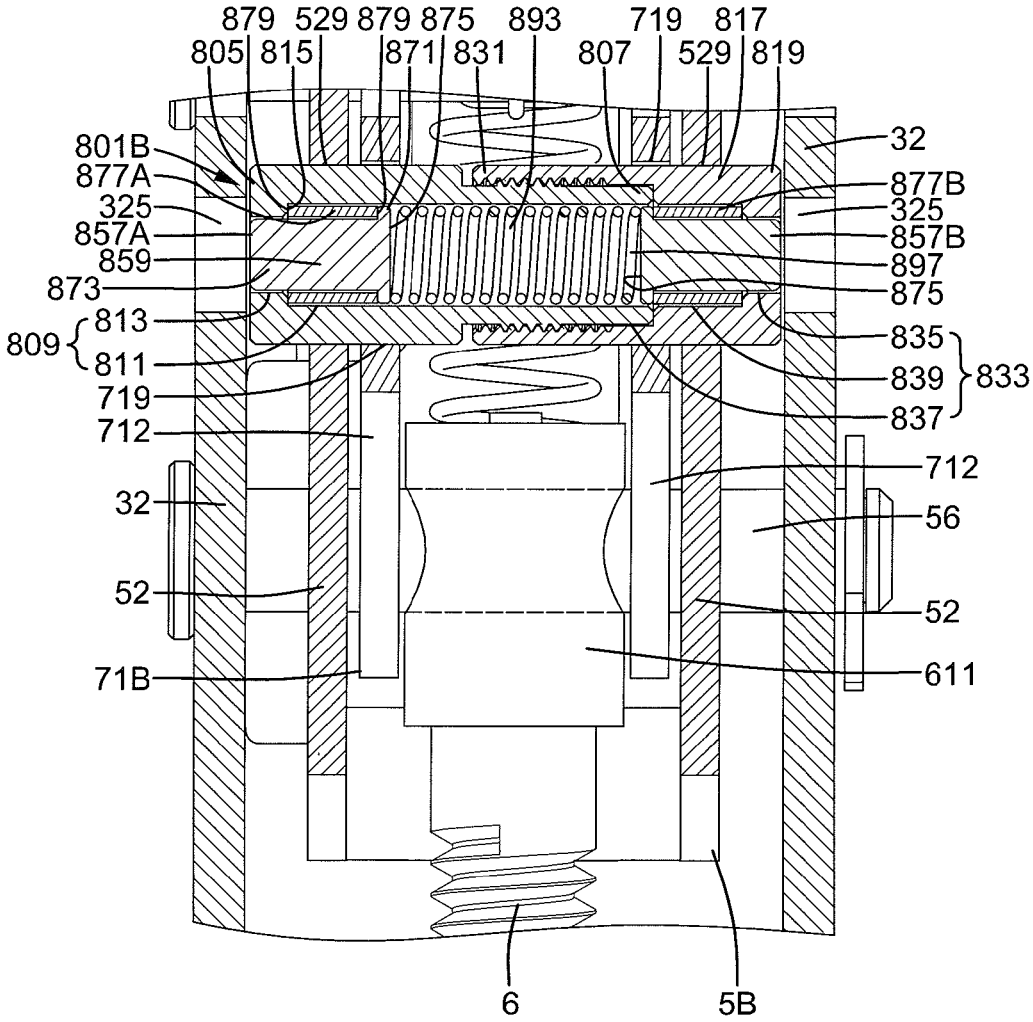
FIG. 10 shows a cross sectional view taken along section line 10-10 of FIG. 9.

When latches 41 of top and bottom latches 24 and 25 are in their latching positions (FIGS. 4 and 9), first and second safety pins 857A and 857B of first and second safety devices 801A and 801B are in their retracted positions in first and second sleeves 803 and 817 (FIGS. 5 and 10). Smaller section 813 of first sleeve 803 and first hole section 835 of second sleeve 817 of first safety device 801A are aligned with positioning holes 325 of base 3 of bottom latch 25. Smaller section 813 of first sleeve 803 and first hole section 835 of second sleeve 817 of second safety device 801B are aligned with positioning holes 325 of base 3 of top latch 24. First end 805 of first sleeve 803 and first end 819 of second sleeve 817 of second safety device 801B are received in reduced ends 527 of engagement holes 525B of follower plate 5B of top latch 24 (FIG. 9). Since first and second safety pins 857A and 857B of first and second safety devices 801A and 801B are in the retracted positions, latches 41 of top and bottom latches 24 and 25 can be moved from the latching positions (FIGS. 4 and 9) to the unlatching positions (FIGS. 6 and 11) by operating touch bar 22. When latch 41 of top latch 24 moves from the latching position to the unlatching position, second safety device 801B moves jointly with safety plate 71B, such that first end 805 of first sleeve 803 and first end 819 of second sleeve 817 of second safety device 801B are received in enlarged end 529 of engagement holes 525B of follower plate 5B of top latch 24 (FIG. 11).

In a case that a fire occurs while latches 41 of top and bottom latches 24 and 25 are in the latching positions (FIGS. 4 and 9), first and second stops 877A and 877B of first and second safety devices 801A and 801B made of plastic melt due to the heat. Each first safety pin 857A of first and second safety devices 801A and 801B is moved from the retracted position to an extended position into one of positioning holes 325 of base 3 of top or bottom latch 24 or 25 under the action of safety spring 893. Likewise, each second safety pin 857B of first and second safety devices 801A and 801B is moved from the retracted position to an extended position into the other positioning hole 325 of base 3 of top or bottom latch 24 or 25 under the action of safety spring 893. Thus, follower plate 5A and safety plate 71A of bottom latch 25 are positioned by first and second safety pins 857A and 857B of first safety device 801A. Follower plate 5B and safety plate 71B of top latch 24 are positioned by first and second safety pins 857A and 857B of second safety device 801B. As a result, top and bottom latches 24 and 25 can not be unlatched by operating touch bar 22 during the fire. Thus, latches 41 of top and bottom latches 24 and 25 can effectively be retained in the latching positions during the fire, avoiding expansion of the fire by avoiding opening of door 1.

By providing restraining slots 523A in follower plate 5A of bottom latch 25 and first guiding slots 323 of base 3, safety plate 71A can move relative to follower plate 5A, so that engaging notches 715 of safety plate 71A can prevent picking of latch 41 of bottom latch 25. Furthermore, positioning pin 72 positions follower plate 5A when latch 41 is in the unlatching position, so that latch 41 in the unlatching position will not move beyond base 3 due to the plays of the parts of door lock 2 or bottom latch 25. Furthermore, first ends 713 of safety plate 71A can push positioning pin 72 to disengage positioning pin 72 from engaging notches 524A of follower plate 5A, allowing latch 41 of bottom latch 25 to move from the unlatching position to the latching position.

Now that the basic teachings of the present invention have been explained, many extensions and variations will be obvious to one having ordinary skill in the art. For example, follower plate 5A does not have to include engagement holes 525A, base 3 of bottom latch 3 does not have to include positioning holes 325, and bottom latch 25 does not have to include first safety device 801A. In this case, although latch 41 of bottom latch 25 can still be retained in the latching position during the fire as long as latch 41 of top latch 24 is retained in the latching position by second safety device 801B. Although top and bottom latches 24 and 25 including first and second safety devices 801A and 801B provide synergistic results, top and bottom latches 24 and 25 do not have to include first and second safety devices 801A and 801B according to user needs.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A latch assembly for a door lock comprising, in combination:

a base including first and second sidewalls and a main section extending between the first and second sidewalls, with each of the first and second sidewalls of the base including a first sliding slot, a first guiding slot, and a second guiding slot, with the first guiding slot of each of the first and second sidewalls of the base including a vertical section and an inclined section, with the main section adapted to be mounted to a door;

a latch movably received between the first and second sidewalls of the base, with the latch having a first pivotal portion pivotably connected to the first and second sidewalls of the base and a second pivotal portion, with the latch movable between a latching position outside the base and an unlatching position inside the base;

a link including a first end pivotably connected to the second pivotal portion of the latch and a second end, with the second end of the link slideably engaged with the first and second sidewalls of the base, with movement of the link along a first axis causing movement of the latch between the latching position and the unlatching position;

a follower plate movable along the first axis, with the follower plate including first and second sidewalls spaced along a second axis perpendicular to the first axis and an intermediate portion extending between the first and second sidewalls of the follower plate, with each of the first and second sidewalls of the follower plate including first and second ends, with the first and second sidewalls of the follower plate movably received between the first and second sidewalls of the base, with a restraining slot formed in each of the first and second sidewalls of the follower plate and located between the first and second ends of the first and second sidewalls of the follower plate, with the restraining slot of each of the first and second sidewalls of the follower plate including upper and lower edges spaced along the first axis and parallel, spaced, first and second lateral edges extending between the upper and lower edges, with the upper edge having an upper end connected to an upper end of the first lateral edge, with the upper edge having a lower end connected to an upper end of the second lateral edge, with the first and second lateral edges substantially parallel to the vertical sections of the first guiding slots of the base, with a first corner formed between a lower end of the second lateral edge and an end of the lower edge, with a second corner formed between the upper end of the upper edge and the upper end of the first lateral edge, with a third corner formed between a lower end of the first lateral edge and another end of the lower edge, with each of the first and second sidewalls of the follower plate further including an engaging notch and a slot, with the restraining slot located between the engaging notch and the intermediate portion of the follower plate along a third axis perpendicular to the first and second axes, with the slot extending in a direction parallel to the first and second lateral edges, with the first ends of the first and second sidewalls of the follower plate pivotably connected to the second end of the link, with the first corners of the restraining slots of the follower plate aligned with the inclined sections of the first guiding slots of the base when the latch is in the latching position, with the second corners of the restraining slots of the follower plate aligned with distal ends of the vertical sections of the first guiding slots of the base and with the engaging notches of the follower plate aligned with the second guiding slots of the base when the latch is in the unlatching position;

a linking rod including a first end slideably coupled with the slots of the follower plate, with the linking rod further including a second end adapted to be connected to a door lock mounted to the door to move therewith;

a safety plate mounted between the first and second sidewalls of the follower plate, with the safety plate including two sidewalls spaced along the second axis, with each of the two sidewalls of the safety plate including first and second ends, with the second end of the two sidewalls of the safety plate pivotably connected to the first end of the linking rod, with each of the two sidewalls of the safety plate further including an engaging notch and a first hole, a pin extending through the first guiding slots of the base, the restraining slots of the follower plate, and the first holes of the safety plate, with the safety plate pivotable relative to the follower plate about a pivot axis defined by the pin, a positioning pin extending through the second guiding slots of the base;

a spring attached between the positioning pin and the pin to bias the positioning pin and the pin towards each other, wherein with the latch in the latching position, the engaging notches of the safety plate are engaged with the positioning pin, the pin is located in distal ends of the inclined sections of the first guiding slots of the base and in the first corners of the restraining slots of the follower plate, with the safety plate being stopped by the positioning pin when the latch is picked, preventing the latch from moving from the latching position to the unlatching position by avoiding the follower plate from moving along the first axis, wherein with the latch in the latching position and with the linking rod moving along the first axis away from the latch through a travel substantially equal to a length of each of the slots of the follower plate, the engaging notches of the safety plate disengage from the positioning pin and the pin moves to an intersection of the vertical section and the inclined slot of each of the first guiding slots of the base and abuts the first lateral edge of each of the restraining slots of the follower plate, wherein with the latch in the latching position and with the linking rod moving along the first axis away from the latch through a travel larger than the length of each of the slots of the follower plate, the latch moves from the latching position to the unlatching position, the positioning pin moves along the second guiding slots of the base under action of the spring and engages with the engaging notches of the follower plate to retain the latch in the unlatching position, and the pin is located in the distal ends of the vertical sections of the first guiding slots of the base and in the second corners of the restraining slots of the follower plate, wherein with the latch in the unlatching position and with the linking rod moving along the first axis towards the latch through a travel slightly smaller than the length of each of the slots of the follower plate, the first ends of the two sidewalls of the safety plate press against the positioning pin to move the positioning pin along the second guiding slots of the base, disengaging the positioning pin from the engaging notches of the follower plate and releasing the follower plate, and the latch moves from the unlatching position to the latching position, with an engagement hole formed in each of the first and second sidewalls of the follower plate and located between the first and second ends of the first and second sidewalls of the follower plate, with the engagement holes of the follower plate aligned with the positioning holes of the base when the latch is in the latching position, with the engagement holes of the follower plate not aligned with the positioning holes of the base when the latch is in the unlatching position, with each of the two sidewalls of the safety plate further including a second hole between the second end and the engaging notch of the safety plate, with the latch assembly further comprising:

a first sleeve including first and second ends spaced along the second axis, with a receiving hole extending from the first end through the second end of the first sleeve, with the receiving hole including a smaller section extending from the first end towards but spaced from the second end of the first sleeve and a larger section extending from the second end through the smaller section and having a diameter larger than the smaller section, with the first end of the first sleeve received in the second hole of one of the two sidewalls of the safety plate and the engagement hole of the first sidewall of the follower plate, allowing joint movement of the first sleeve and the safety plate;

a second sleeve including first and second ends spaced along the second axis, with a mounting hole extending from the first end through the second end of the second sleeve, with the mounting hole including a first hole section extending through the first end of the second sleeve, with the mounting hole further including a second hole section extending through the second end of the second sleeve, with the second end of the second sleeve engaged with the second end of the first sleeve, with the first end of the second sleeve received in the second hole of another of the two sidewalls of the safety plate and the engagement hole of the second sidewall of the follower plate, allowing joint movement of the second sleeve and the safety plate;

a first stop having a melting point lower than the first and second sleeves, with the first stop received in the larger section of the receiving hole of the first sleeve;

a second stop having a melting point lower than the first and second sleeves, with the second stop received in the mounting hole of the second sleeve;

a first safety pin received in the receiving hole of the first sleeve, with the first safety pin including a first shank having a first distal end, with the first safety pin further including a first flange formed on an end of the first shank opposite to the first distal end and having a diameter larger than a diameter of the first shank, with the first shank of the first safety pin extending through the first stop into the smaller section but not extending beyond the first end of the first sleeve, with the first stop located between the first flange of the first safety pin and the smaller section of the first sleeve;

a second safety pin received in the mounting hole of the second sleeve, with the second safety pin including a second shank having a second distal end, with the second safety pin further including a second flange formed on an end of the second shank opposite to the second distal end and having a diameter larger than a diameter of the second shank, with the second shank of the second safety pin extending through the second stop into the first hole section but not extending beyond the first end of the second sleeve, with the second stop located between the second flange of the second safety pin and the first hole section of the second sleeve;

a safety spring mounted in the larger section of the receiving hole of the first sleeve, with the safety spring including a first end pressing against the first flange of the first safety pin and a second end pressing against the second flange of the second safety pin, with the safety spring biasing the first and second safety pins towards the first and second sidewalls of the base, wherein with the latch in the latching position and with the first and second stops melted by heat, the safety spring moves the first distal end of the first safety pin into the positioning hole of the first sidewall of the base and moves the second distal end of the second safety pin into the positioning hole of the second sidewall of the base, preventing the follower plate from moving relative to the base along the first axis, retaining the latch in the latching position.

2. The latch assembly as claimed in claim 1, with the first lateral edge having a length along the first axis larger than a length of the second lateral edge along the first axis, with the upper edge of each of the restraining slots substantially parallel to the inclined sections of the first guiding slots of the base, with a spacing between the first corner and the second corner along the first axis substantially equal to a spacing between the third corner and the second corner along the first axis, with the lower end of the upper edge located between the upper and lower ends of the first lateral edge along the first axis.

3. The latch assembly as claimed in claim 1, with each of the engagement holes of the follower plate being larger than the first ends of the first and second sleeves, with the engagement holes allowing movement of the first ends of the first and second sleeves when the first and second sleeves are moving jointly with the safety plate.

4. The latch assembly as claimed in claim 1, with each of the first and second stops including a through-hole through which one of the first and second safety pins extends, with the first safety pin having a length along the second axis equal to or slightly smaller than a sum of a length of the first stop and a length of the smaller section of the first sleeve along the second axis, with the second safety pin having a length along the second axis equal to or slightly smaller than a sum of a length of the second stop and the first hole section of the second sleeve.

5. The latch assembly as claimed in claim 4, with the mounting hole of the second sleeve including an intermediate hole section between the first hole section and the second hole section, with the intermediate hole section having an inner diameter larger than an inner diameter of the first hole section but smaller than an inner diameter of the second hole section, with a first abutment face formed at an intersection of the first hole section and the intermediate hole section, with a second abutment face formed at an intersection of the intermediate hole section and the second hole section, with the second end of the first sleeve abutting the second abutment face, with the second stop received in the intermediate hole section of the second sleeve and having an end abutting the first abutment face.

* * * * *